US007018757B2

(12) United States Patent
Zhu et al.

(10) Patent No.: US 7,018,757 B2
(45) **Date of Patent: *Mar. 28, 2006**

(54) PHOTOCONDUCTOR MATERIALS BASED ON COMPLEX OF CHARGE GENERATING MATERIAL

(75) Inventors: Jiayi Zhu, Woodbury, MN (US); Zbigniew Tokarski, Woodbury, MN (US); James A. Baker, Hudson, WI (US); Ronald J. Moudry, Woodbury, MN (US); David T. Ask, Somerset, WI (US); Nusrallah Jubran, St. Paul, MN (US); Kam W. Law, Woodbury, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/356,683

(22) Filed: Jan. 31, 2003

(65) Prior Publication Data

US 2004/0152000 A1 Aug. 5, 2004

(51) Int. Cl.
*G03G 5/047* (2006.01)

(52) U.S. Cl. ..... 430/59.5; 430/56; 430/78; 430/133

(58) Field of Classification Search ..... 430/56, 430/78, 59.5, 133; 540/141
See application file for complete search history.

(56) References Cited

U.S. PATENT DOCUMENTS 4,898,799 A 2/1990 Fujimaki et al. ..... 430/59
6,500,592 B1 * 12/2002 Sugai ..... 430/58.25
6,815,132 B1 * 11/2004 Zhu et al. ..... 430/58.45
2001/0044061 A1 * 11/2001 Sugai et al. ..... 430/58.5

FOREIGN PATENT DOCUMENTS

| | | |
|---|---|---|
| EP | 0433172 | 6/1991 |
| EP | 0506387 | 9/1992 |
| EP | 0550161 | 7/1993 |
| GB | 1472605 | 5/1977 |
| JP | 56-116040 | 2/1955 |
| JP | 43-16198 | 11/1965 |
| JP | 47-21617 | 12/1972 |
| JP | 54-79632 | 12/1977 |
| JP | 55-22834 | 8/1978 |
| JP | 61-239248 | 4/1985 |
| JP | 11124512 | 5/1999 |

* cited by examiner

*Primary Examiner*—John L Goodrow
(74) *Attorney, Agent, or Firm*—Mark A. Litman & Associates, P.A.

(57) ABSTRACT

An electrophotographic article having a complex of charge generating material and at least one transfer material selected from the group consisting of electron transfer material and hole transfer material is formed by admixing the charge generating material, at least one transfer material, and an organic binder in a solvent to form a coatable dispersion comprising a complex of charge generating material and said at least one transfer material; and coating said coatable dispersion onto a conductive substrate to form a charge transfer layer on the electrophotoconductive article. A novel S-form titanyl oxyphthalocyanine is also preferred, the novel form displaying major peaks of Bragg's 2theta angle to the CuK-alpha characteristic X-ray (wavelength 1.541 Angstrom) at least at 9.5±0.2 degrees, 9.7±0.2 degrees, 11.7±0.2 degrees, 13.5±0.2 degrees, (optionally at 21±0.2 degrees and/or 23.5±0.2 degrees,) 24.1±0.2 degrees, 26.4±0.2 degrees, and 27.3±0.2 degrees group. Additional peaks, approaching or equivalent to major peaks, may also be present as 15.0, 15.3 and 16.0±0.2 degrees.

18 Claims, 32 Drawing Sheets

PHOTOCONDUCTOR MATERIALS BASED ON COMPLEX OF CHARGE GENERATING MATERIAL

BACKGROUND OF THE INVENTION

1. Field of the Invention

This invention relates to a photoreceptor for electrophotography, particularly to complexes of charge generating materials useful in forming electrophotographic media, particularly complexes of organic charge generating materials with a) charge transfer materials or b) electron transfer materials and preferably complexes of a new crystalline form of titanium phthalocyanine. The photoconductor systems are suitably used for any electrographic or electrophotographic process such as those used in printers, copying machines, etc. The photoconductor systems may have high sensitivity to long wavelength light and semiconductor laser beam rather than only to visible light.

2. Background of the Art

Electrophotographic photoreceptors having photosensitivity to visible light have been widely used for copying machines, printers, etc. The materials originally used as electrophotographic photoreceptors, usually inorganic photoreceptors, comprised a photosensitive layer (on a conductive support) comprising selenium, zinc oxide, cadmium sulfide, and other inorganic photoconductive substances as the main ingredients have been widely used. However, these inorganic photoreceptors were not always satisfactory with respect to photosensitivity, thermal stability, water/humidity stability, durability and other characteristics required in electrophotographic photoreceptors for copying machines and others. For instance, selenium is inclined to be crystallized by heat or stained by fingerprints, which easily deteriorate the desired characteristics of the photoconductor. Electrophotographic photoreceptors using cadmium sulfide are inferior in water stability and durability and those using zinc oxide have a problem in durability, especially with regard to humidity and physical stress. Electrophotographic photoreceptors using selenium and cadmium sulfide also have disadvantageous restrictions in their manufacture and handling.

To improve upon and avoid such problems of inorganic photoconductive substances, various organic photoconductive substances have been used for photosensitive layers of electrophotographic photoreceptors. For instance, an organic photoreceptor using a photosensitive layer containing poly-N-vinyl carbazole and 2,4,7-trinitrofluorenone is disclosed in Japanese Unexamined Patent Publication No. 50-10496. This photoreceptor is, however, not sufficient with respect to sensitivity and durability. Therefore, an electrophotographic photoreceptor of the separated function type with two layers, a photosensitive layer composing a carrier generating layer and a carrier transporting layer independently, which respectively contain a carrier generating substance and carrier transporting substance, were developed. This enables different substances to assume the carrier generating function and carrier transporting function independently. Therefore, a wide range of substances can be selected that have one of the functions.

Thus, it is expected to obtain organic photoreceptors with high sensitivity and durability. Many carrier generating substances effective for the carrier generating layer of electrophotographic photoreceptors of the separate function type have been proposed. As an example of those using inorganic substances, amorphous selenium can be used as presented in the Gazette for the Japanese Unexamined Patent Publication No. 43-16198. This carrier generating layer containing the amorphous selenium is used in combination with a carrier transporting layer containing organic carrier transporting substance. However, the carrier generating layer comprising the amorphous selenium has the trouble of crystallization due to heat resulting in deterioration of the characteristics as described above. As an example using an organic substance as the carrier generating substance, there are organic dyes or pigments. For instances, those with a photosensitive layer containing bis-azo compounds represented in the Gazettes for Japanese Unexamined Patent Publication Nos. 47-37543, 55-22834, 54-79632, 56-116040, etc. have been already known.

However, though these bis-azo compounds represent relatively favorable sensitivity in the short and medium wavelength ranges, they are low in sensitivity in long wavelength range. It was difficult to use them in laser printers which use semiconductor laser beam sources and they require high reliability.

The gallium aluminum arsenide (Ga/Al/As) type light emitting element which is now widely used as semiconductor laser is more than 750 mm in oscillating wavelength. In order to obtain electrophotographic photoreceptors of high sensitivity for such long wave length light, many studies have been done. For instance, such a method was conceived as to add sensitizing agent to photosensitive materials such as Se, CdS and others with high sensitivity in the visible light range to make the wavelength longer. As described above, however, Se and CdS have not yet sufficient environmental resistance to temperature, humidity, etc. Also, a large number of organic type photoconductive materials have been known as described above; their sensitivity is limited to the visible light region below 700 nm usually and only a very small number of materials have enough sensitivity for longer wavelengths.

Among available charge generating materials, phthalocyanine type compounds are known to have photosensitivity in the long wavelength region. Among them, alpha-type titanyl phthalocyanine is presented in the Gazzette for the Japanese Unexamined Patent Publication No. 61-239248. This type titanyl phthalocyanine has peaks in terms of Bragg's 2theta angle when exposed to X-rays generated from a CuK-alpha source (wavelength 1.541 Angstroms) at 7.5, 12.3, 16.3, 25.3, and 28.7 degrees. However, its sensitivity is low and electric potential stability is inferior in repeated use and is susceptible to photographic fog in electrophotographic processes using reversal development. Electrification power is also low and a sufficient image density is hard to obtain.

U.S. Pat. No. 4,898,799 describes a photoreceptor containing a titanyl phthalocyanine with the major peaks of Bragg's 2theta angle to the CuK-alpha characteristic X-ray (wavelength 1.541 Angstroms) at least at 9.5±0.2 degrees, 9.7±0.2 degrees, 11.7±0.2 degrees, 15.0±0.2 degrees, 23.5±0.2 degrees, 24.1±0.2 degrees, and 27.3±0.2 degrees group. The production method of titanyl phthalocyanine was performed, for example, with titanium tetrachloride and phthalodinitrile mixed in alpha-chloronaphthalene solvent. The resulting dichloro titanium phthalocyanine (TiCl.sub.2 Pc) was hydrolyzed to obtain alpha-type titanyl phthalocyanine. This was processed by 2-ethoxyethanol, diglyme, dioxane, tetrahydrofuran, N,N-dimethyl formamide, N-methyl pyrrolidone, pyridine, morpholine, and other solvents which are electron donors.

Most system rely upon incidental association of the charge generating material and electron transfer material or charge transfer material. This can lead to variation in consistency within a single product, within lots of the same product, and between runs of the same product. Inconsistency in imaging is never a desirable characteristic.

SUMMARY OF THE INVENTION

Complexes are provided for inclusion as functional material within electrophotographic imaging layers. Charge generating materials (CGM) are complexed with one of a) electron transfer material (ETM) and b) charge transfer material (CTM). By forming a complex of these materials before coating of the functional layer that ordinarily contains both of these component materials of the electrophotographic element, more uniform association of the active materials (e.g., CGM/ETM or CGM/CTM) is provided, more consistent products are provided, and product that exhibit greater speed can be provided.

Any metallic phthalocyanine known in the art, such as titanium phthalocyanine, copper phthalocyanine, oxytitanium phthalocyanine (also referred to as titanyl oxyphthalocyanine, and including any crystalline phase or mixtures of crystalline phases that can act as a charge generating compound), and hydroxygallium phthalocyanine, is useful in the practice of the invention, particularly any crystalline phase of titanyl oxyphthalocyanine. However, a proprietary crystalline phase of titanyl oxyphthalocyanine is preferred. That proprietary crystalline phase is referred to herein as the S-phase. That proprietary crystalline phase of titanyl oxyphthalocyanine comprises an internal blend of lattice arrangements provided by various treatments of a different form of the titanyl oxyphthalocyanine crystal (preferably starting with the gamma-form). The S-phase is a truly new phase (with spectral emission and absorption properties exhibited by a single crystal), and is not a mixture of distinct particles of various phases (e.g., combinations of particles of the beta-phase and the gamma-phase), with the internal lattice distributions in the S-phase of atoms and molecules forming a new, continuous, non-uniform lattice structure. The X-ray spectrum shows a blend of diffraction peaks, having peaks that have previously been distinctly present only collectively among various crystalline forms of titanyl phthalocyanine, but can now be provided in a single crystalline form.

This invention relates to a photoreceptor containing a complex of titanyl phthalocyanine, with the preferred proprietary titanyl oxyphthalocyanine having major peaks of Bragg's 2theta angle to the CuK-alpha characteristic X-ray (wavelength 1.541 Angstrom) at least at 9.5±0.2 degrees, 9.7±0.2 degrees, 11.7±0.2 degrees, 13.5±0.2 degrees, 24.1±0.2 degrees, 26.4±0.2 degrees, and 27.3±0.2 degrees. Additional peaks, approaching or equivalent to major peaks may also be present as 15.0, 15.3 and 16.0±0.2 degrees. Other features that may be present, but are not necessarily specific identifiers of the S-form could be a beta-form peak at 21.0±0.2 degrees, and a shoulder at 23–23.5±0.2 degrees. As an option to using this preferred charge generating material, alpha-phase, beta-phase and gamma-phase titanyl oxyphthalocyanine crystals and the titanyl oxyphthalocyanine described in U.S. Pat. No. 4,898,799 (which is incorporated herein by reference) may be used in forming complexes of the invention.

BRIEF DESCRIPTION OF DRAWINGS

The drawings illustrate aspects of this invention, in which the properties of titanium (titanyl) oxyphthalocyanines are shown in graphic representations. It is to be noted that in all Figures and examples that all γ-forms (gamma-forms) are the same chemical composition and substantially the same crusyalline structure, but vary in lot numbers. The variations in properties shown are variations common to variations in lots, as understood in the art.

DETAILED DESCRIPTION OF THE INVENTION

Figure 1:
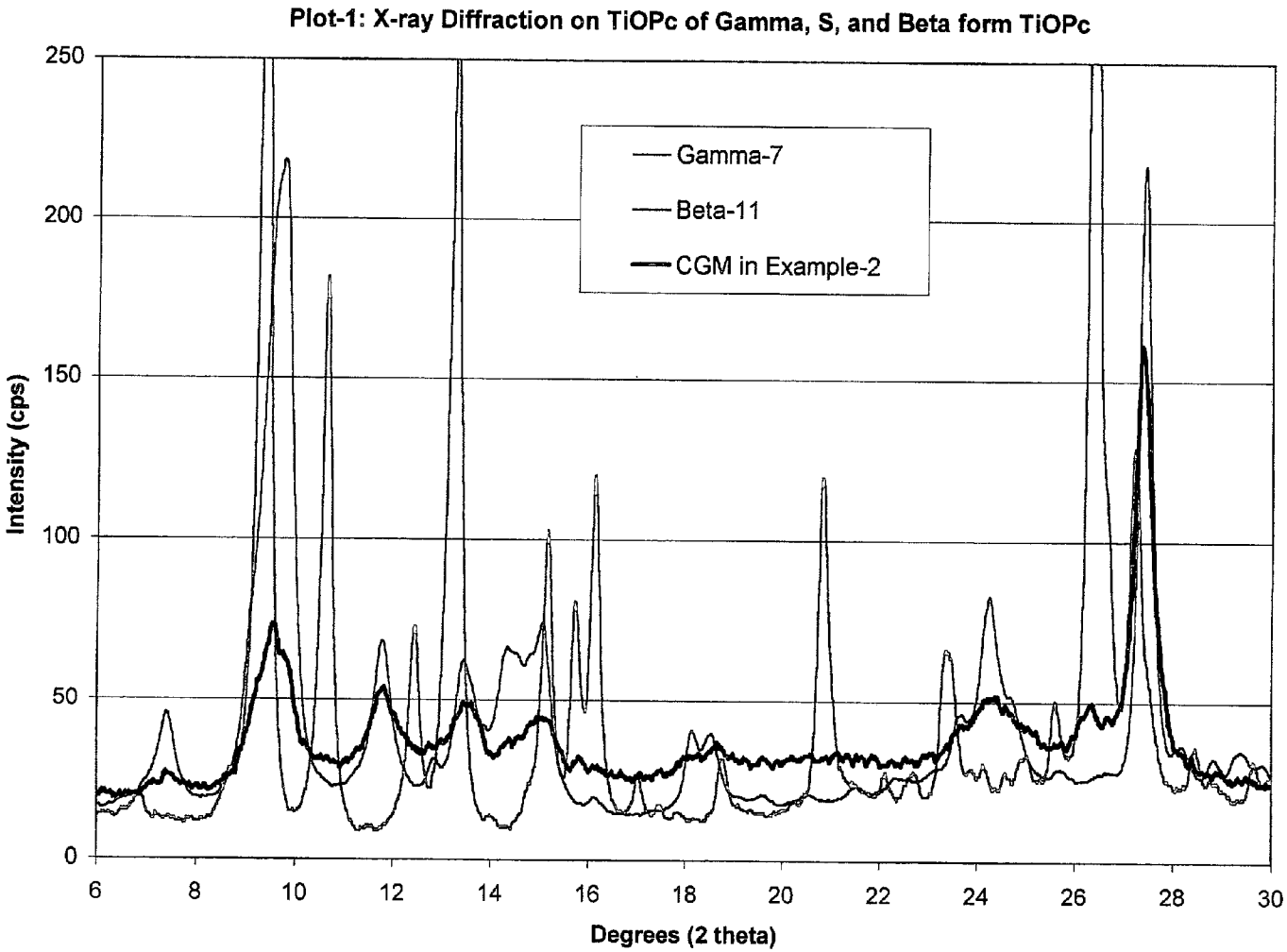
FIG. 1 shows X-ray diffraction of three samples of titanyl oxyphthalocyanine (TiOPc): Gamma-7 (commercially available), Beta-11 (commercially available), and one sample milled in MEK.

Complexes formed among Charge Generating Materials (especially titanyl oxyphthalocyanine crystals) and either Electron Transfer Materials or Charge Transfer Materials (also referred to herein as Hole Transfer Materials) provide useful material for electrophotographic elements, particularly for organic photoconductive materials. The complexes appear to be classic complexes, formed between two compounds that form coordinate bonds (which may or may not be to the titanium atom or ion). It is inconsequential as to which molecule (the charge generating compound on the one hand and either the electron transfer material or the hole transfer material on the other hand) is defined or acts as the ligand or the chelate, as long as the complex is formed between the respective groups. Not all materials from the various compounds forming the complexes need be present as a complex. Some materials may remain as distinct compounds either because of an excess of one or more materials, incompletion complexing between the compounds during preparation, or separation of the complexed compounds during coating, storage or usage (e.g., as a result of competing compounds, heat, humidity, or any other unfavorable conditions that may occur during various stages of manufacture, conversion, storage or use of the electrophotoconductive layers and compositions of the invention).

The distribution of complexed and non-complexed compounds from the two groups of materials that form complexes within at least a single layer of the electrophotoconductive element may vary significantly, dependent upon the reaction conditions and the specific materials used. It is believed that at least 10% (on a molar basis) of the ingredient with the lowest concentration should be complexed, preferably at least 10%, at least 25%, at least 30%, at least 40%, at least 50%, a majority of the material with the lowest concentration, at least 55%, at least 65%, or at least 75% by molar basis should be present as a complex. For example, assuming a one-to-one ligand to chelate stoichiometry, if there were 3.0 moles of Charge Generating Material and 1.0 moles of Electron Transfer Material or Hole Transport Material, then at least 10% (0.10 mole) of the ETM or HTM should be provided as a complex with the CGM. Different methodologies of determining the degree of complexing may be needed, as one or more ingredients may be present in particulate form. For example, the titanyl oxyphthalocyanine may be present as crystalline particles, so the calculation of complexing in terms of moles may be difficult. The degree of complexing should therefore be considered in terms of percentage of available complexing sites on the surface of the crystal. This can be calculated by statistical analysis. The maximum amount of complexing that can be performed on the surface of that particular crystal phase and size can be determined by conventional equilibrium physical chemistry analysis. The maximum number or moles/surface area of the non-crystalline compound can be measured. The amount of complexing that should occur on the surface of the crystal can then be considered in terms of that maximum theoretically available amount of complexing/weight of that crystalline phase and that size of crystal. Similar to the molar percentages, the percent of maximum theoretical complexing that can occur should be 10%, at least 25%, at least 30%, at least 40%, at least 50%, at least 55%, at least 65%, or at least 75% by maximum theoretical surface area basis should be present as a complex.

The exact mechanism for forming complex between the charge generating material and the hole transfer material or the electron transfer material may vary according to materials, and the sizes of particles and the binders and solvents, but a complex is formed. As the CTM in certain environments are molecularly dispersed glasses stabilized by the polymer binder and are not really particles in the true sense like the CGM pigment, dissolved complexes may be formed. Where the CGM is a molecular glass, the particle size may vary, and in theoretical terms it is not definite that a molecular glass still can be considered a particle.

Since the charge transfer material in other environments may tend to be particles of approximately uniform size (e.g., with a sigma of ±40% for at least 95% by number of the particles, and preferably a sigma of ±25% for at least 95% by number of the particles), the degree of complexing may also be described in those different environments as at least 25% by number of the particles within either a sigma of ±40% for at least 95% by number of the particles, or preferably a sigma of ±25% for at least 95% by number of the particles are complexed. Similarly, at least 30% by number, at least 45% by number, at least 50% by number, at least 60% by number, at least 75% by number or at least 90% by number of the particles within these sigma distribution ranges should be complexed. The ranges are chosen for this determination, as some of the particles outside of the range on the small end of the scale would be difficult to analyze, even though they are just as likely to be complexed as many of the other particles.

Titanyl oxyphthalocyanine according to this invention is used as a charge generating material when used as an electrophotographic photoreceptor of the separate function type. It composes a photoreceptor in combination with a carrier transporting substance. The preferred titanyl oxyphthalocyanine according to this invention is different from the many individual types of titanyl oxyphthalocyanine described above and in the prior art. The present crystalline form of titanyl oxyphthalocynaine has X-ray diffraction spectrum with a unique combination of major peaks. These major peaks sharply project from the background noise of the Bragg's 2theta angle to the CuK-alpha characteristic X-ray (wavelength 1.541 Angstrom) at least at 9.5±0.2 degrees, 9.7±0.2 degrees, 11.7±0.2 degrees, 13.5±0.2 degrees, 21±0.2 degrees, 23.5±0.2 degrees, 24.1±0.2 degrees, 26.4±0.2 degrees, and 27.3±0.2 degrees group. Additional peaks, approaching or equivalent to major peaks may also be present as 15.0, 15.3, and 16.0±0.2 degrees as described above. The titanium oxyphthalocyanine according to this invention has a distinctly different crystal form from that of the crystalline types previously noted in the literature, comprising an internal, continuous/non-uniform blend of different lattice structures.

This invention also relates to a photoreceptor containing a titanyl phthalocyanine with the major peaks of Bragg's 2theta angle to the CuK-alpha characteristic X-ray (wavelength 1.541 Angstrom) at least at 9.5±0.2 degrees, 9.7±0.2 degrees, 11.7±0.2 degrees, 13.5±0.2 degrees, 24.1±0.2 degrees, 26.4±0.2 degrees, and 27.3±0.2 degrees. Additional peaks, approaching or equivalent to major peaks may also be present as 15.0, 15.3 and 16.0±0.2 degrees. Other features that may be present, but are not necessarily specific identifiers of the S-form could be a beta-form peak at 21.0±0.2 degrees, and a shoulder at 23–23.5±0.2 degrees.

Titanyl oxyphthalocyanine according to this invention (referred to herein as the "S-form") presents a special spectrum which has not been seen in a single crystal before as described above.

The above X-ray diffraction spectra were measured under the conditions below (same hereafter).

X-ray tube bulb: Cu
Voltage: 40.0 KV
Current: 100.0 mA
Start angle: 6.00 deg.
Stop angle: 35.00 deg.
Step angle: 0.020 deg.
Measuring time: 0.50 sec.

It has been recognized in the past that milling conditions, solvents used, temperatures used, additional additives, and the type of milling used have an unpredictable effect upon the resulting crystalline phase or form structure resulting from the milling. However, there is no basis for predicting in advance of the actual use of new combinations of parameters precisely what the resulting crystalline form (and its attendant X-ray diffraction pattern) will be. There has been no basis for being able to predict whether any specific set of parameters (in the absence of their actually having been tried) will produce any one of the specific forms available in the numerous forms that appear to be available with titanyl oxyphthalocyanines. U.S. Pat. No. 4,898,799 established that the presence of a single new peak or the absence of a previous peak was clear evidence that different lattice structure and a different crystalline form were present in the product. Even a single major peak difference (by way of presence or absence) is conclusive evidence of different overall lattice structure. The term "major peak" should not be a subjective term, but its utilization in the art to distinguish between materials has rendered the term somewhat subjective if not ambiguous. The term should be considered in light of both absolute and relative intensities generated from X-ray diffraction tests at a constant X-ray intensity, but at the varying angles. For example, the major peaks should have an intensity of at least 50 (cps) or at least 70, or at least 100, when the peak intensity for any peak is above 200 (cps) or the peak intensity for any peak is above 250 (cps). This can be seen by comparing the various peaks within data plots. For example, it would be marginal at best to call the data structure at 7.5 degrees a major peak, while the structures at 11.8 and 24.2 should be termed major peaks, while the structures at 26.4, 21.0, 15.5 and 9.5 must be called major peaks.

Attached are data for beta, gamma, and S-form of TiOPc. Our belief is that S-form TiOPc crystals are different from the crystals of beta-form or gamma-form. The S-form crystals are not a mixture of individual beta crystals and individual gamma crystal phases. However, the S-form crystals have both beta and gamma characteristics and display a collection of major peaks from both forms, without displaying only those peaks within a single previously recognized form. Therefore, the X-ray peaks of the S-form appear in the composite of similar positions as the gamma and beta peaks. However, the S-form is also a generic form. It has many species. Each has a unique ratio of beta and gamma characteristics (both in properties, spectra, and presumably crystalline lattice structure), depending on the degree and direction of transformation.

The process described and provided in the Examples explains why the S-form has both beta and gamma spectra characteristics. The gamma-form is not a stable form of TiOPc. Therefore, it can be converted to another form, and in the specific examples shown, to the S-form easily during milling in a number of defined conditions. The S-form is also not a stable form relative to the beta-form. It can also be converted to beta form if the condition is right. In our belief, the phase transformation process is gamma>S>beta. The atomic arrangement in gamma crystals is in a particular (gamma) pattern whereas the atomic arrangement in the beta crystals is in another particular (beta) pattern. When a gamma crystal start transforming to S-form, part of gamma pattern becomes beta pattern. Both the gamma and beta pattern co-exist in the same crystal. Only when 100% of the gamma pattern transforms into beta pattern, a beta form crystal is formed. When the transformation is less than 100%, only an S-form is obtained. It must be noted that this transformation is within the lattice structure, and is not particle-by-particle gross transformation. Lattice by lattice is translated from one form to the other, passing through the intermediate S-form stage where the crystal structure is neither beta-form nor gamma-form.

FIG. 1 shows the X-ray diffraction of gamma-form (from supplier) and beta-form (from supplier) form crystals, and an S-form (from milling of gamma form, according to Example 2).

Figure 2:
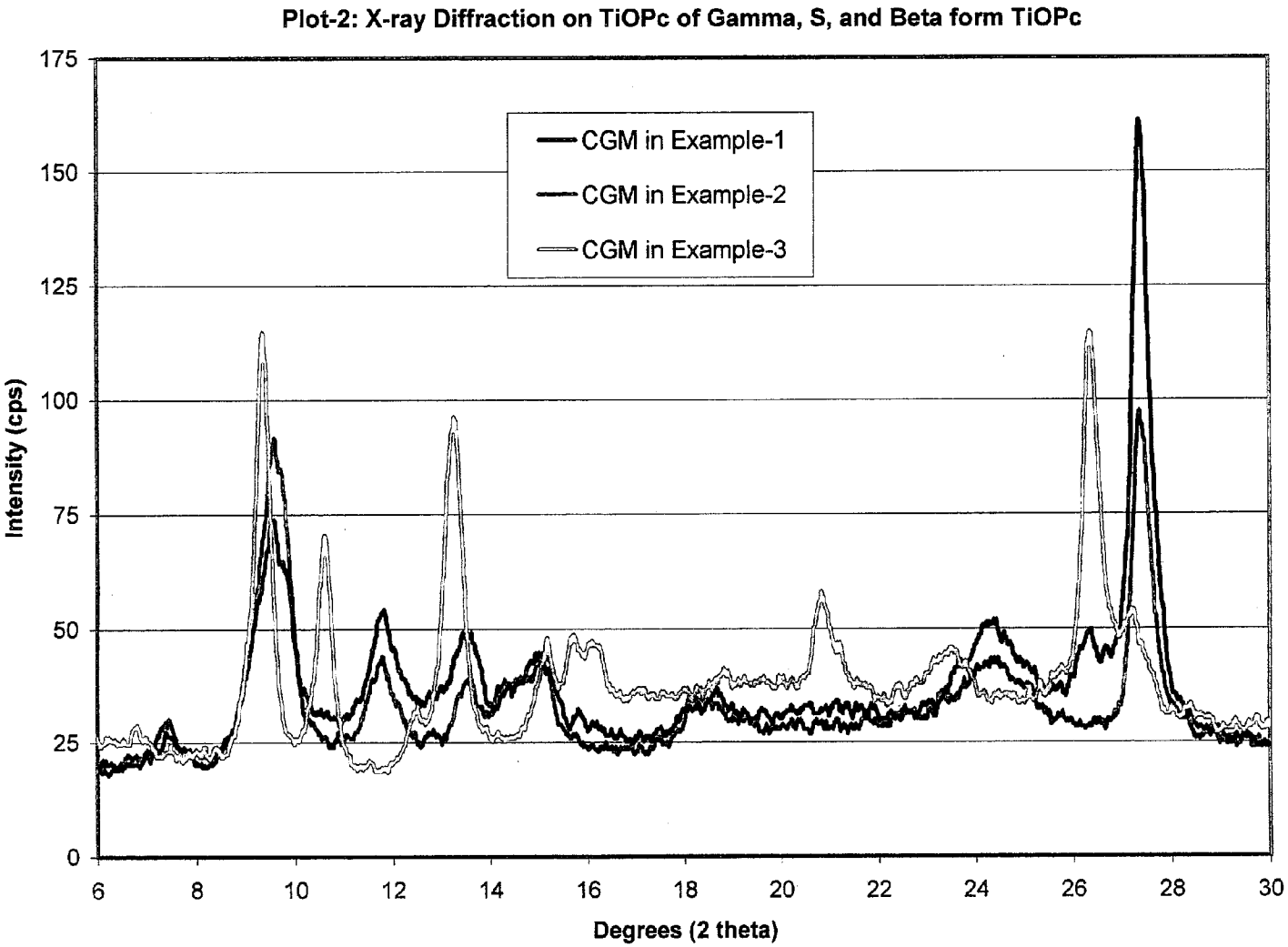
FIG. 2 shows the X-ray diffraction spectrum of three samples of gamma-form titanyl oxyphthalocyanine that were milled with different binders in different solvents using different milling methods. Example-1, -2, and -3 are in beta-form, S-form, and gamma-form, respectively, the data shown in Table 5.
Figure 3:
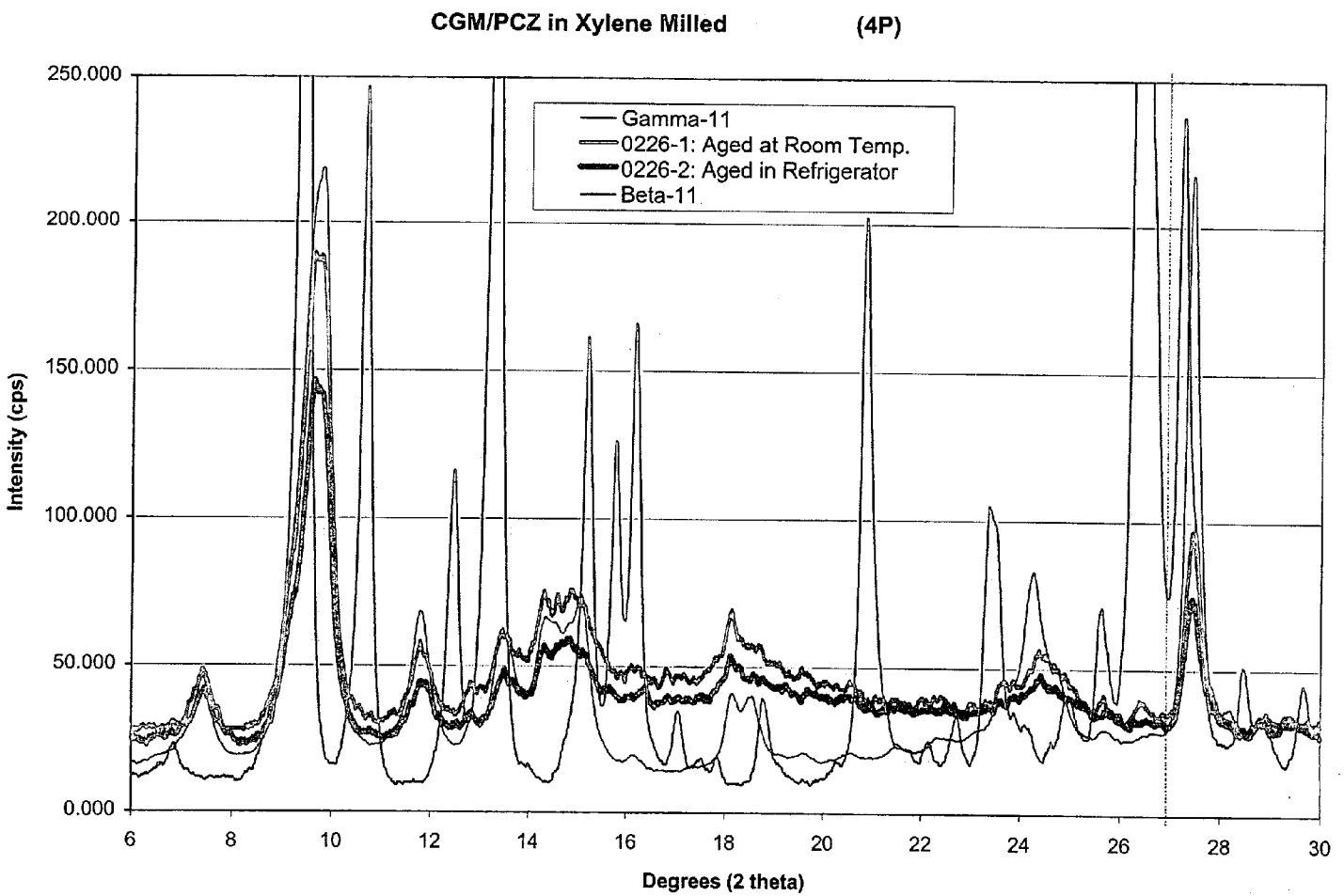
FIG. 3 shows an X-ray diffraction spectrum of four samples of titanyl oxyphthalocyanine (TiOPc), two of which were aged.
Figure 4:
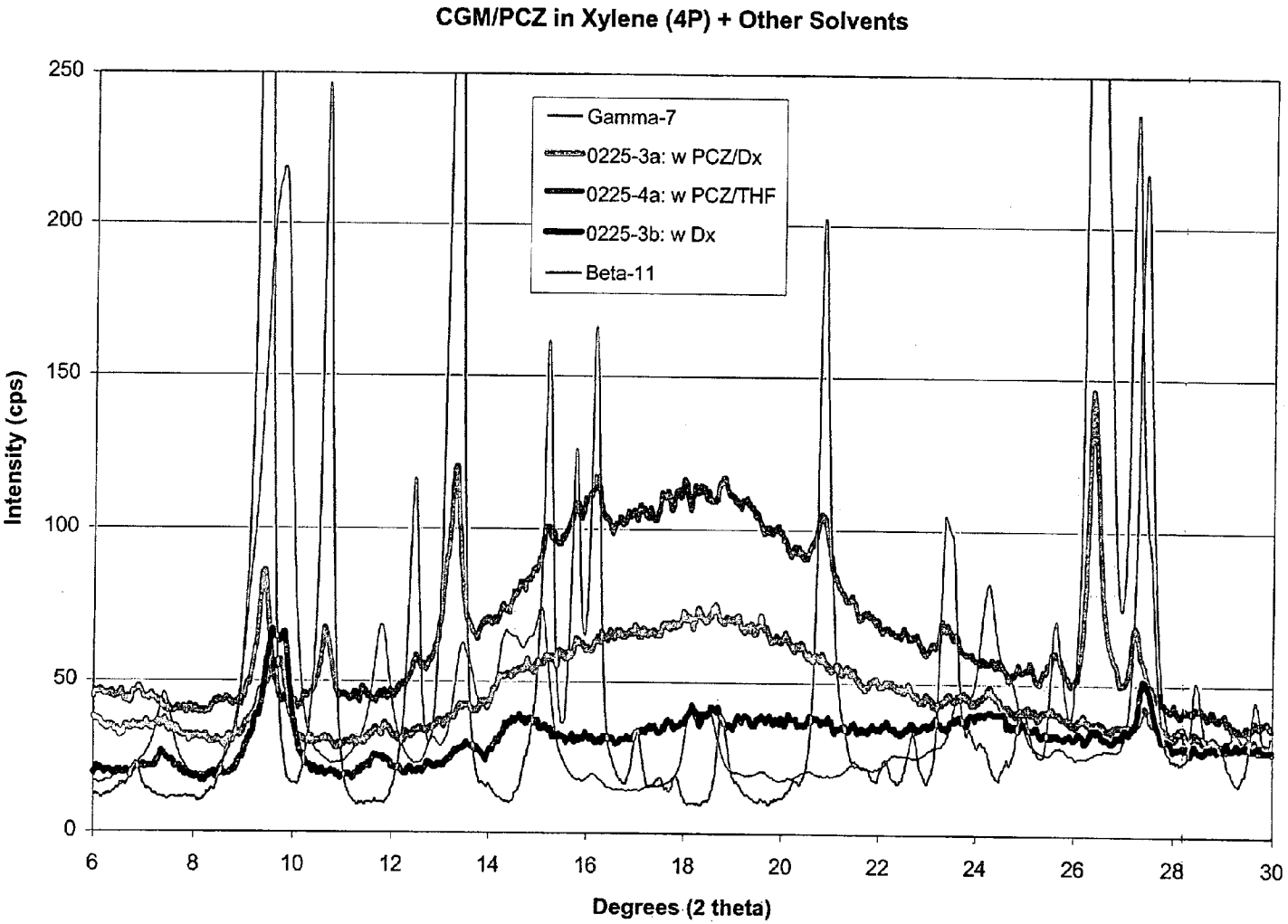
FIG. 4 shows the X-ray diffraction spectrum of five samples of titanyl oxyphthalocyanine: three of which were milled in pass mode for 4 passes with PCZ binder (polycarbonate Z) in Xylene and then different solvents added after milling.
Figure 5:
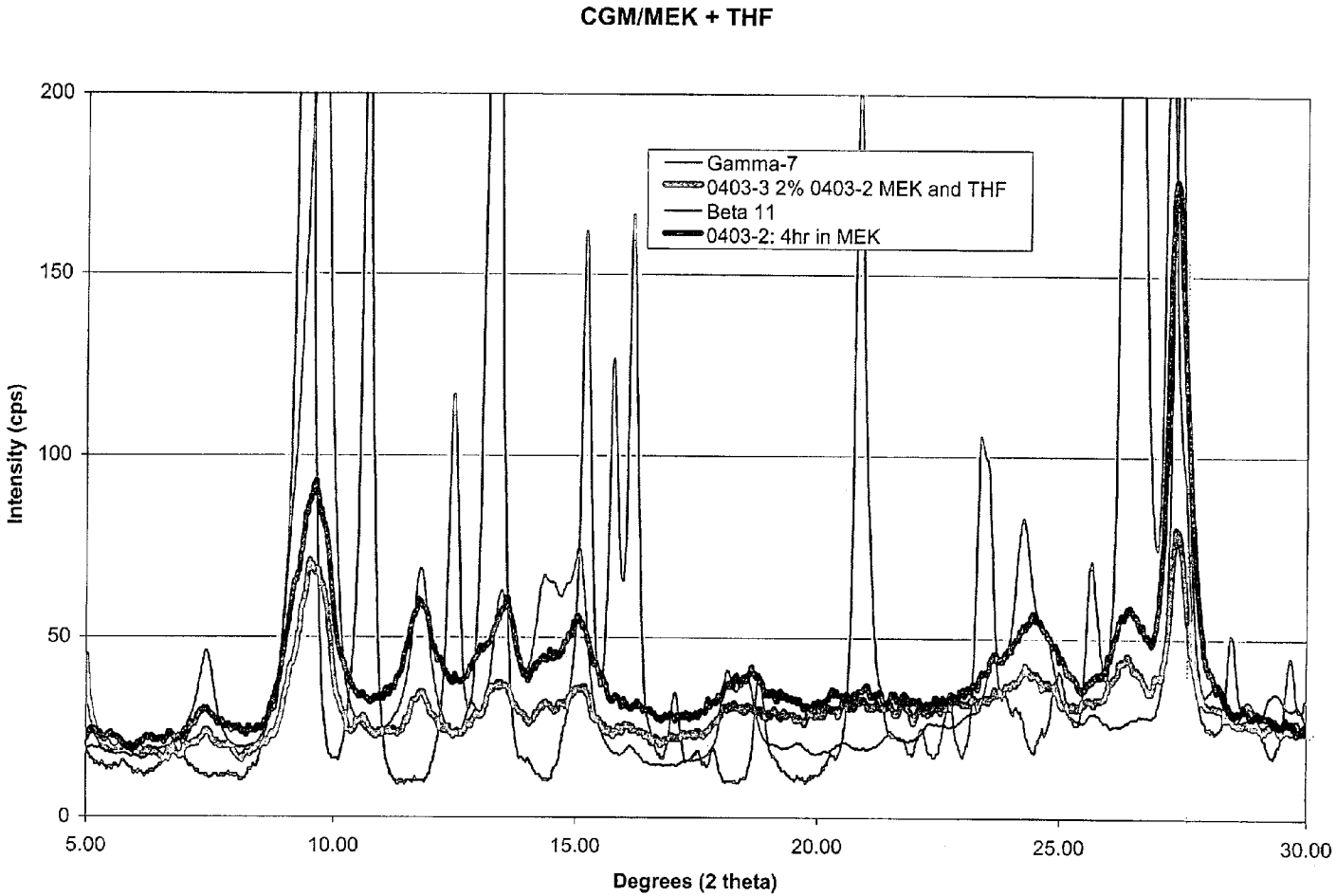
FIG. 5 shows X-ray diffraction spectrum of four samples of titanyl oxyphthalocyanine: two milled with BX-5 (polyvinyl butyral) in MEK solvent and then THF was added to one sample millbase.

FIG. 2 shows the X-ray diffraction of three examples of gamma form TiOPc milled in different solvents and different binders with different milling methods. The crystal form in the resulting CGM millbases for Ex-1, Ex-2 and Ex-3 are gamma-, S-, and beta-forms, respectively.

Table 5 tabulates the X-ray peaks of Examples 1–3. It also provides the peak area of each peak.

Table 6 is the electrostatic data of single layer OPC (organic photoconductor) coatings that were formulated with the three CGM millbases of TiOPc as shown in FIG. 1 and in Table-1 (i.e., Examples 1–3). Please notice the performance of Example 2 is arguably better than both beta-form and gamma-form with regard to the S-forms ability to hold a higher charge and then discharge to a lower level.

Figure 30:
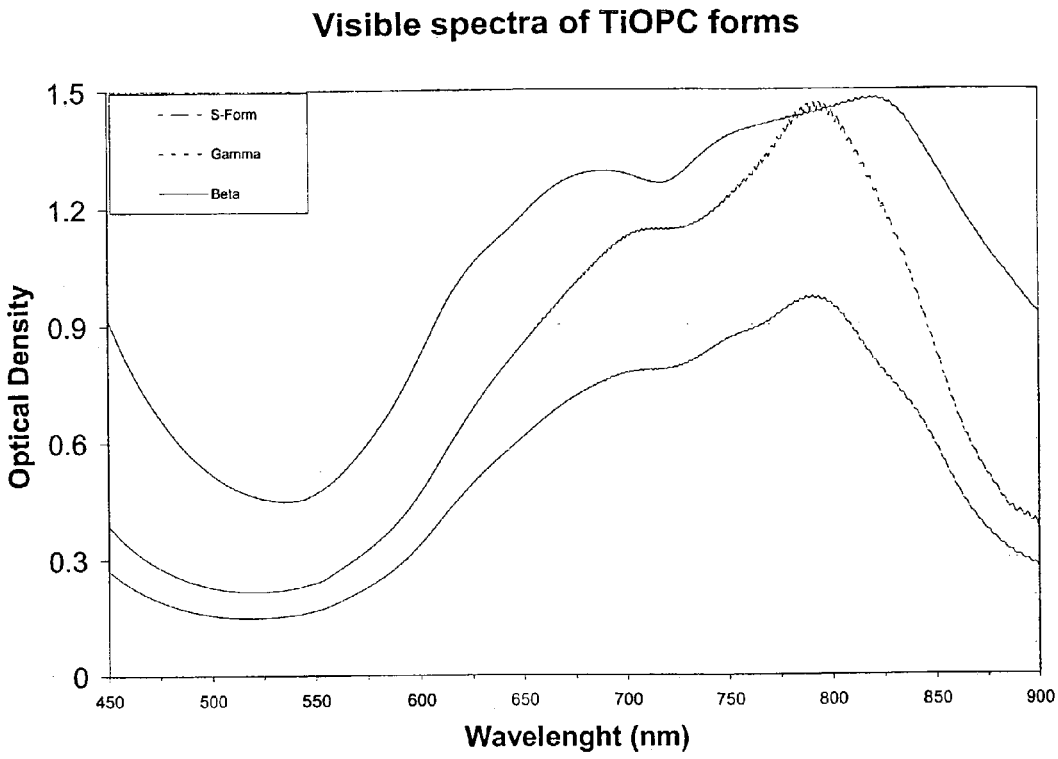
FIG. 30 shows Visible Spectra of TiOPc forms, specifically beta-form, gamma-form, and S-form TiOPc produced by milling under appropriate conditions.

FIG. 30 shows Visible Spectra of Beta, Gamma and S-form Titanyl Oxyphthalocyanine crystals produced by the milling process. It is to be noted that the visible spectra, as with the X-ray diffraction spectra, shows significant differences. The beta form shows higher absorption above 850 nanometers as compared to both the S-form and the Gamma form. The S-form shows much lower absorption at 790–800 nm than the gamma-form and the beta-form, even after correction of any base-line differences that might be implied. In view of the substantively identical chemical composition of the three forms, the difference in visible spectra is again supportive of the different crystal and lattice structure among the three forms.

It is desirable to use the titanyl oxyphthalocyanine obtained as described above in a dry condition but it may be used in the form of wet paste. For the dispersive medium to be used for agitating and milling, those which are usually used for dispersion or emulsifying pigments, etc. such as glass beads, steel beads, alumina beads, flint stone, etc. can be cited. However, a dispersive medium is not always required. As an auxiliary agent for frictional crushing, those used as auxiliary agents for frictional crushing of pigments such as common salt, sodium bicarbonate, Glauher's salt, etc. can be cited. However, an auxiliary agent for frictional crushing is not always necessary.

When solvent is required for agitating, milling, or frictional crushing, those which are liquefied at the temperature at the time of agitating or milling may be used. For instance, the prior art (e.g., U.S. Pat. No. 4,898,799) had indicated that it was desirable to select more than one of the solvents such as alcohol type solvent (such as glycerol, ethylene glycol, diethylene glycol) or polyethylene glycol type solvent, ethylene glycol monomethyl ether, ethylene glycol monoethyl ether, and other cellosoluble type solvents, ketone type solvents, esterketone type solvents, etc. It has been found in the practice of the present invention that milling in methylethylketone (THF produces beta form when milled, but addition of THF to CGM in ethyl acetate millbase will produce S-form) enables formation of the S-form, while other solvents have not been tested under conditions where that specific transition is controllable and sufficiently stable. Representative equipment used for the crystal inversion processes are general agitating equipment such as homomixer, disperser, agitator, stirrer, kneader, Banbury mixer, ball mill, sand mill, attritor, sonic mixers, etc. Temperature range for crystal inversion processes is 30–180° C., desirably 40 degree–130° C. As in usual crystal inversion processes, using a crystalline germ is also effective.

In this invention, other charge generating materials (consistency) may be used jointly with the above described titanyl oxyphthalocyanine. Charge generating materials which may be used jointly with titanyl oxyphthalocyanine are, for example, alpha-type, beta-type, gamma-type, x-type, tau-type, tau'-type, and eta-type and eta'-type titanyl or other metallic phthalocyanines. In addition to the above ones, oxyphthalocyanine pigment, azo pigments, anthraquinone pigments, parylene pigments, polycyclic quinone pigments, squaric acid methine pigments, merocyanine pigments, cyanine pigments, etc. can be provided.

In the photoreceptors according to this invention, oxazole derivative, oxadiazole derivative, thiazole derivative, imidazole derivative, imidazolone derivative, imidazolizine derivative, bisimidazolizine derivative, styryl compound, hydrazone compound, pyrazolone derivative, oxazolone derivative, benzothiazole derivative, benzoimidazole derivative, quinazoline derivative, benzofuran derivative, acridine derivative, phenazine derivative, amino stilbene derivative, poly-N-vinyl carbazole, poly-1-vinyl pylene, poly-9-vinyl anthracene, etc. can be used as carrier transporting substances used when separated function type photoreceptors are adopted.

Generally in photoreceptors, a carrier transporting substance effective with a certain carrier generating substance is not always effective with other carrier generating substances. Also a carrier generating substance effective with a certain carrier transporting substance is not always effective with other carriers. In order to use them as electrophotographic photoreceptors, the correct combination of a carrier generating substance and carrier transporting substance is necessary. An improper combination reduces sensitivity of the electrophotographic photoreceptor and especially due to the insufficient discharge efficiency in a low electric field, the residual potential increases. In the worst case, for instance when such an electrophotographic photoreceptor is used for a duplicating machine, an electrical charge is accumulated while it is used repeatedly, and the toner sticks to areas other than the image, staining the base of the copy or damaging the clear duplicated image.

Electron transport materials include, but are not limited to those well known electron transport materials such as bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[ 1,2-b]thiophene-4-one, and 1,3,7-trinitrodibenzothiophene-5,5-dioxide, (2,3-diphenyl-1-indenylidene)malononitrile, 4H-thiopyran-1,1-dioxide and its derivatives such as 4-dicyanomethylene-2,6-diphenyl-4H-thiopyran-1,1-dioxide, 4-dicyanomethylene-2,6-di-m-tolyl-4H-thiopyran-1,1-dioxide, and unsymmetrically substituted 2,6-diaryl-4H-thiopyran-1,1-dioxide such as 4H-1,1-dioxo-2-(p-isopropylphenyl)-6-phenyl-4-(dicyanomethylidene)thiopyran and 4H-1,1-dioxo-2-(p-isopropylphenyl)-6-(2-thienyl)-4-(dicyanomethylidene) thiopyran, derivatives of phospha-2,5-cyclohexadiene, alkoxycarbonyl-9-fluorenylidene)malononitrile derivatives such as (4-n-butoxycarbonyl-9-fluorenylidene)malononitrile, (4-phenethoxycarbonyl-9-fluorenylidene)malononitrile, (4-carbitoxy-9-fluorenylidene)malononitrile, and diethyl(4-n-butoxycarbonyl-2,7-dinitro-9-fluorenylidene)-malonate, anthraquinodimethane derivatives such as 11,11,12,12-tetracyano-2-alkylanthraquinodimethane and 11,11-dicyano-12,12-bis(ethoxycarbonyl)anthraquinodimethane, anthrone derivatives such as 1-chloro-10-[bis(ethoxycarbonyl)methylene]anthrone, 1,8-dichloro-10-[bis(ethoxycarbonyl)methylene]anthrone, 1,8-dihydroxy-10-[bis(ethoxycarbonyl)methylene]anthrone, and 1-cyano-10-bis(ethoxycarbonyl)methylene)anthrone, 7-nitro-2-aza-9-fluroenylidene-malononitrile, diphenoquinone derivatives, benzoquinone derivatives, naphthoquinone derivatives, quinine derivatives, tetracyanoethylenecyanoethylene, 2,4,8-trinitrothioxantone, dinitrobenzene derivatives, dinitroanthracene derivatives, dinitroacridine derivatives, nitroanthraquinone derivatives, dinitroanthraquinone derivatives, succinic anhydride, maleic anhydride, dibromo maleic anhydride, pyrene derivatives, carbazole derivatives, hydrazone derivatives, N,N-dialkylaniline derivatives, diphenylamine derivatives, triphenylamine derivatives, triphenylmethane derivatives, tetracyanoquinonedinethane, 2,4,5,7-tetranitro-9-fluorenone, 2,4,7-trinitro-9-dicyanomethylenenefluorenone, 2,4,5,7-tetranitroxanthone derivatives, and 2,4,8-trinitrothioxanthone derivatives.

Thus, combining a carrier generating substance and carrier transporting substance is important. However, there are no specific general (absolute) rules for selecting such combinations. Finding any carrier transporting substance suitable to a specific carrier generating substance is difficult. In addition, the charge transfer substances according to this invention are safe, favorable in terms of the environment, and they are chemically stable.

As described above, this invention can provide photoreceptors with high sensitivity to long wavelength light, high in electric potential stability when used repeatedly, high in charging ability, and core optimum for reversal development processes.

In the photosensitive layer comprising the photoreceptor, it is desirable that particle carrier generating substance and carrier transporting substance are combined by binder substance (that is, dispersed in the layer in the form of pigment). In such a case, printing resistance, durability, and other characters of the layer are improved, memory phenomenon is decreased, and rest potential becomes stable.

A photosensitive layer of the photoreceptor according to this invention may be composed by providing a layer with the said carrier generating substances dispersed in the binder on an electric conductive support. Or the so-called separate function type photosensitive layer of the laminated layer type or dispersion type may be provided by combining this carrier generating substance and carrier transporting substance.

Figure 6A:
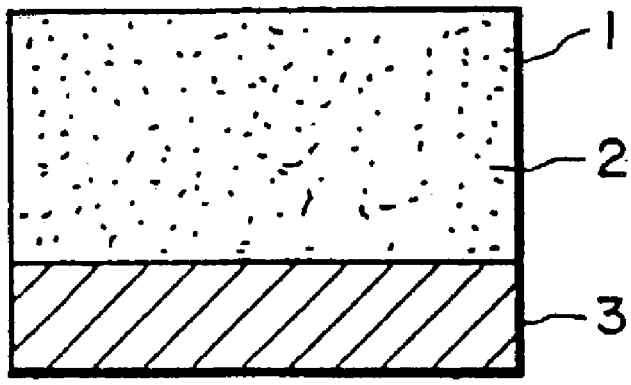
FIGS. 6*a* and 6*b* show cross-sections of electrophotographic structures.
Figure 6B:
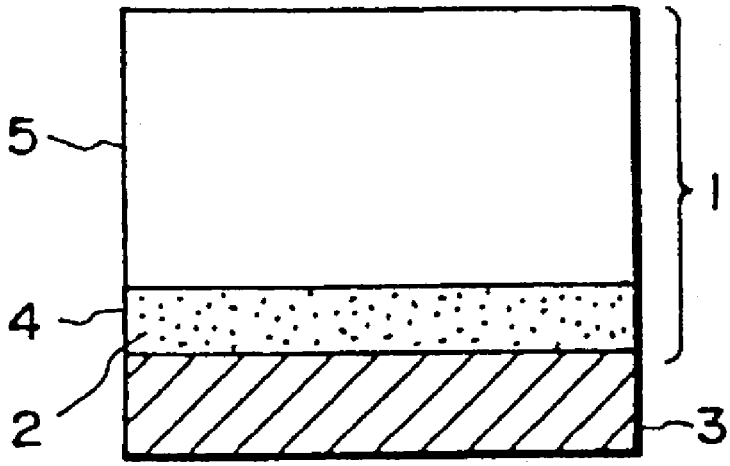
Figure 7:
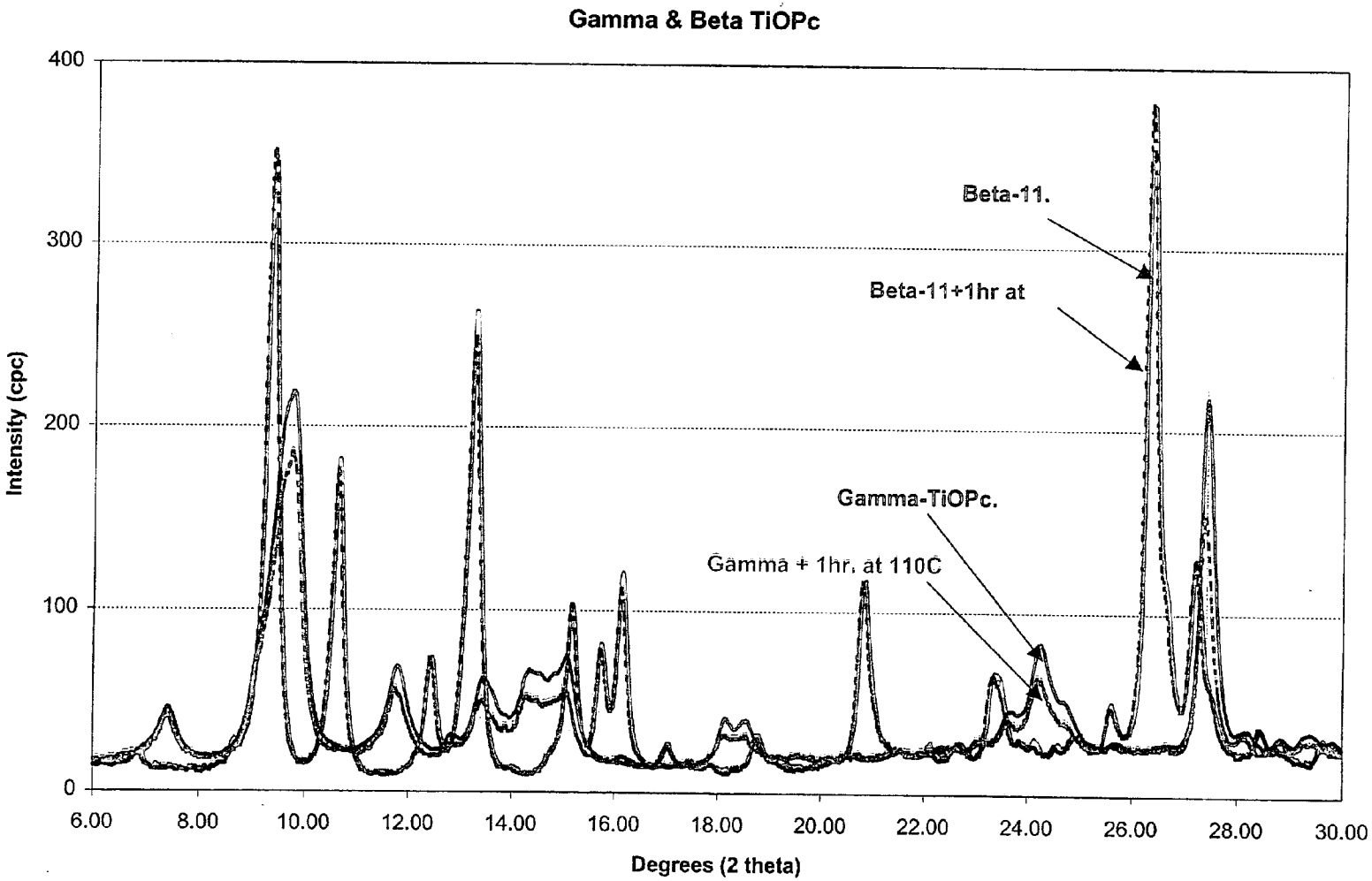
FIG. 7 shows X-ray diffraction data of two sets of neat Beta-11 and Gamma forms of TiOPc, with and without aging for 1 hour at 110° C.
Figure 8:
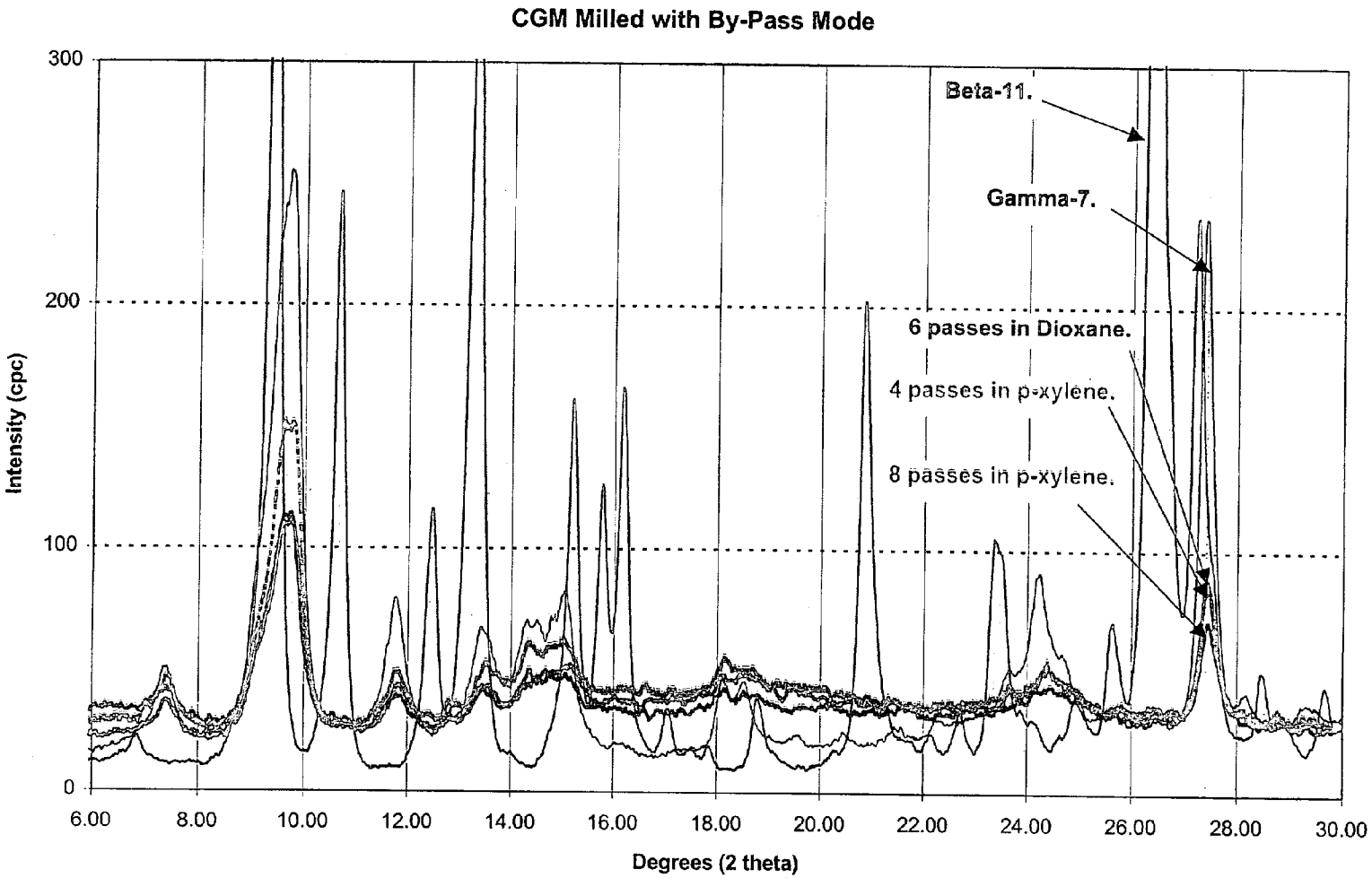
FIG. 8 shows X-ray diffraction spectrum of five samples of titanyl oxyphthalocyanine, three of which were milled in pass mode with PCZ in different solvents for a different number of passes, the data shown in Table 4.
Figure 9:
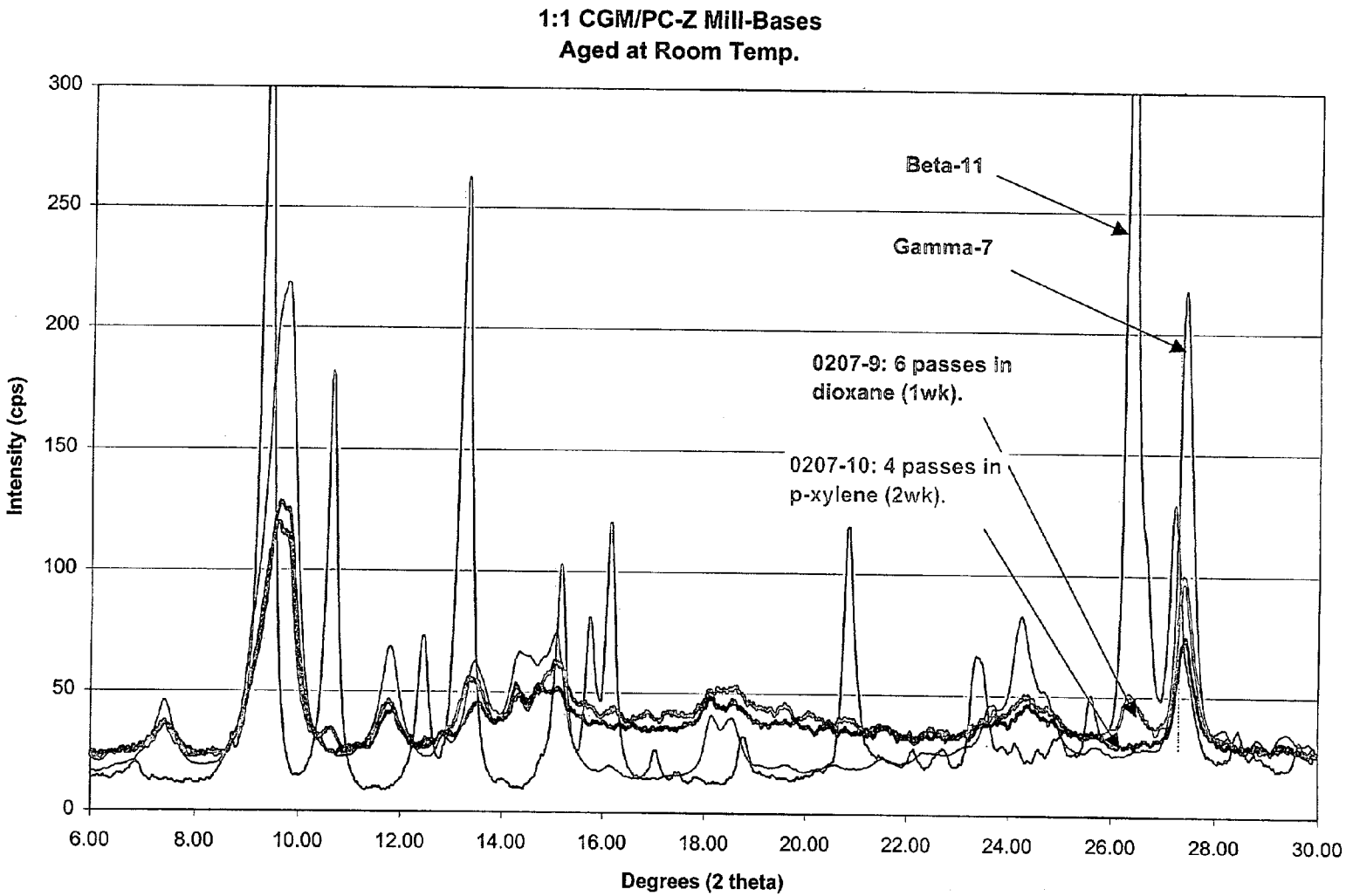
FIG. 9 shows X-ray diffraction spectrum of four samples of titanyl oxyphthalocyanine, two milled with PCZ in different solvents and different aging, the data shown in Table 4.
Figure 10:
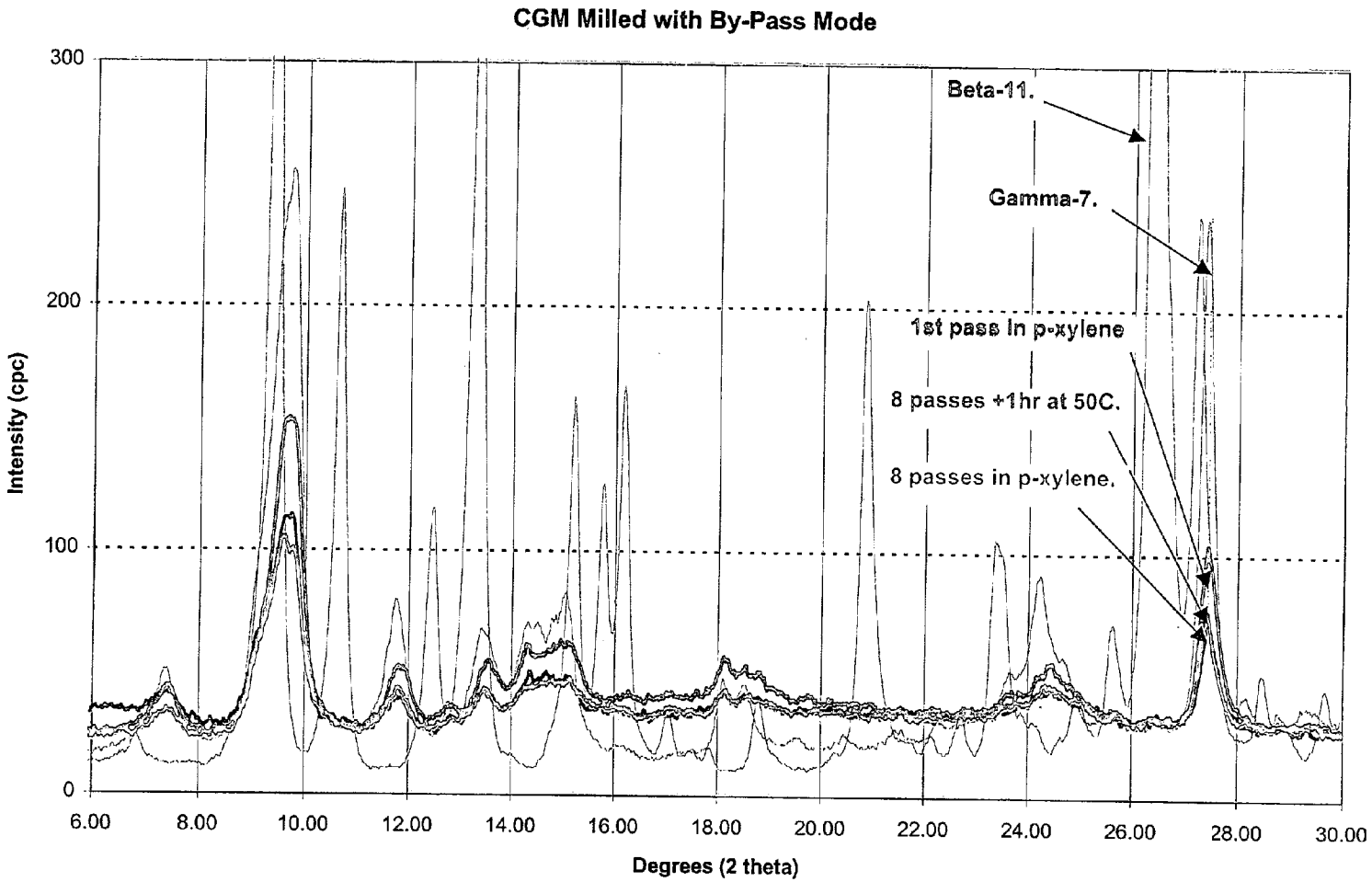
FIG. 10 shows X-ray diffraction spectrum of five samples of titanyl oxyphthalocyanine: three milled in pass mode with PCZ in p-xylene and one aged for 1 hour, the data shown in Table 4.
Figure 11:
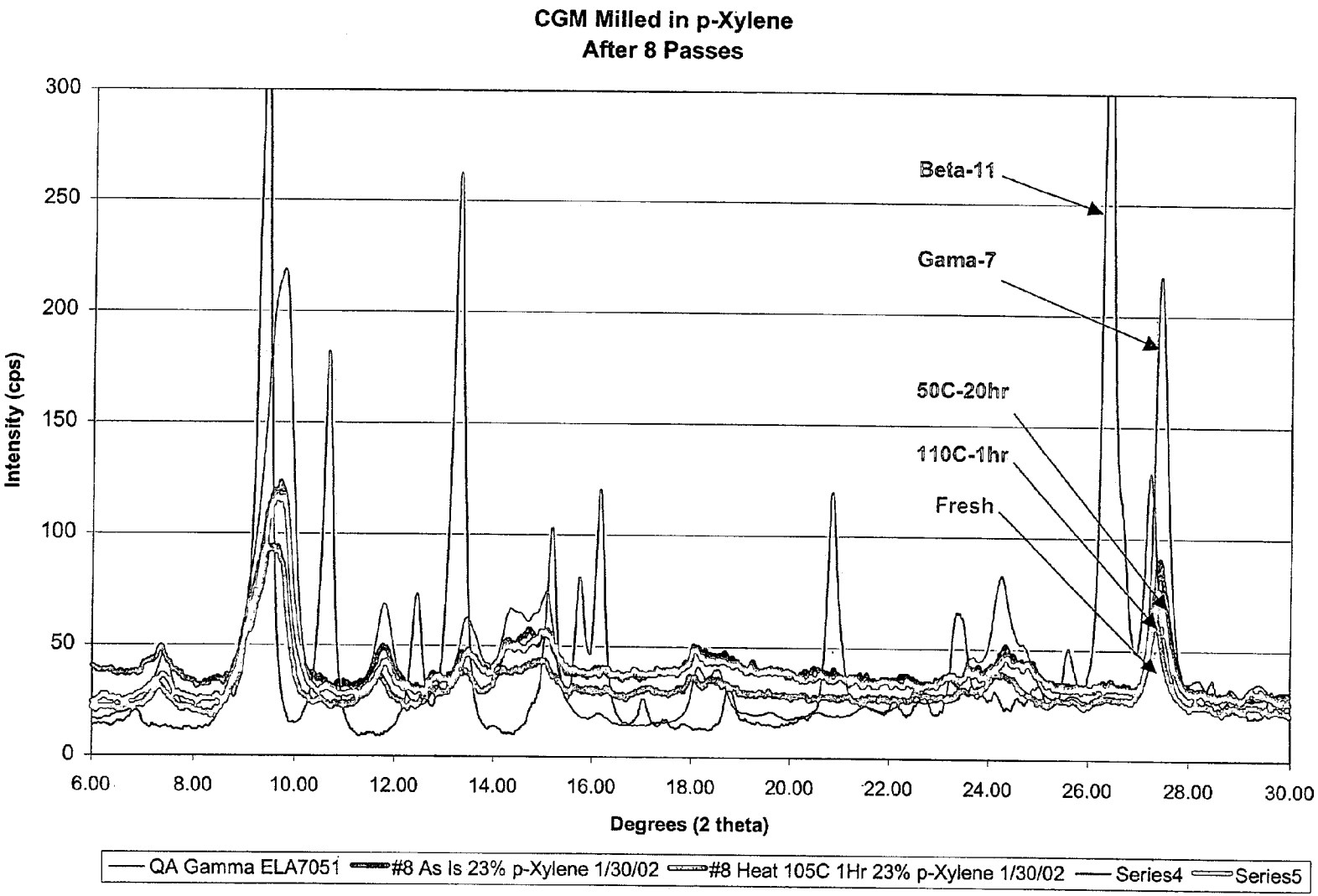
FIG. 11 shows X-ray diffraction spectrum of five samples of titanyl oxyphthalocyanine: three milled in pass mode with PCZ in p-xylene after 8 passes and two of these samples aged, the data shown in Table 4.
Figure 12:
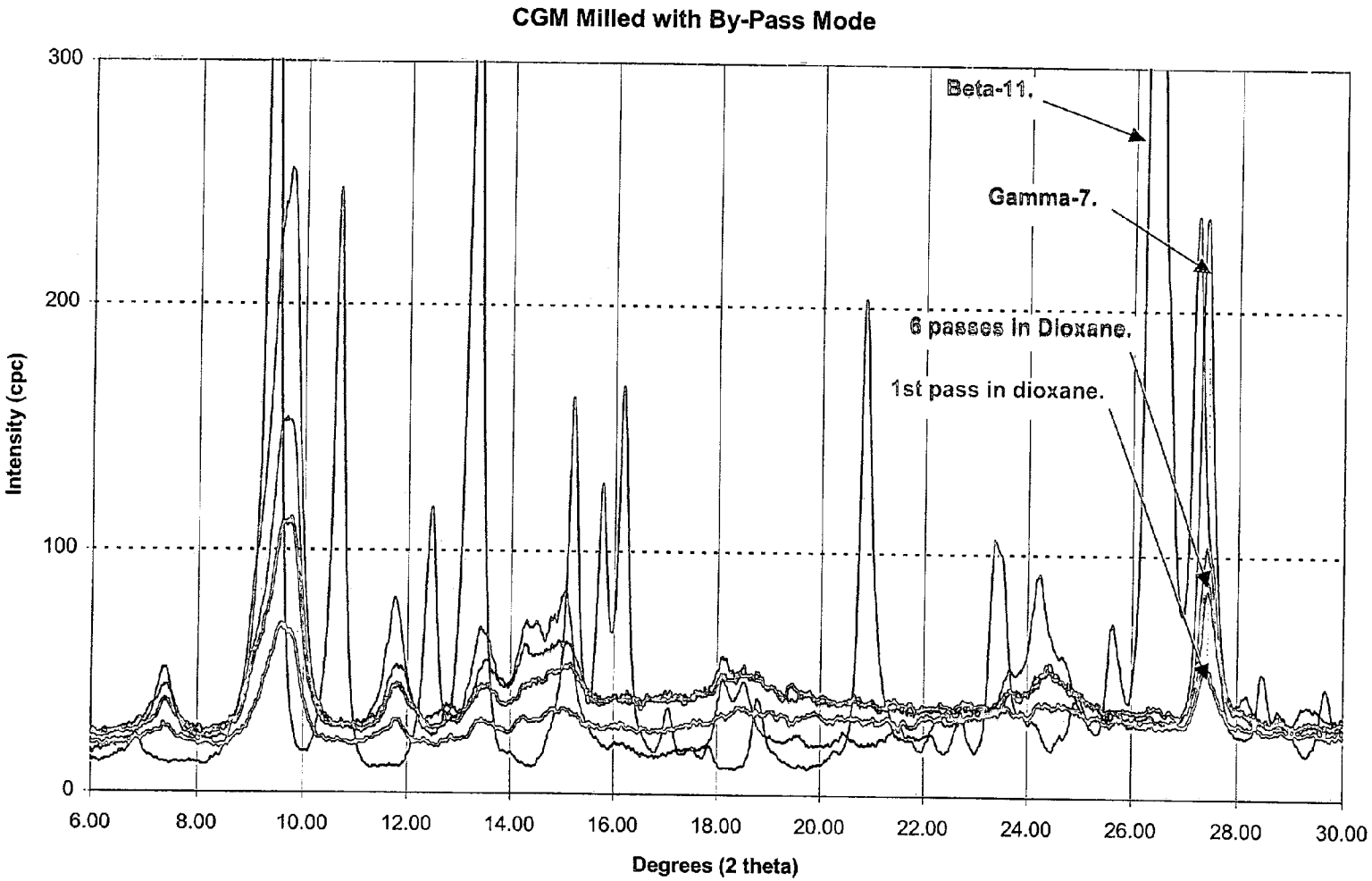
FIG. 12 shows X-ray diffraction spectrum of four samples of titanyl oxyphthalocyanine: two milled in pass mode with PCZ in dioxane, the data shown in Table 4.
Figure 13:
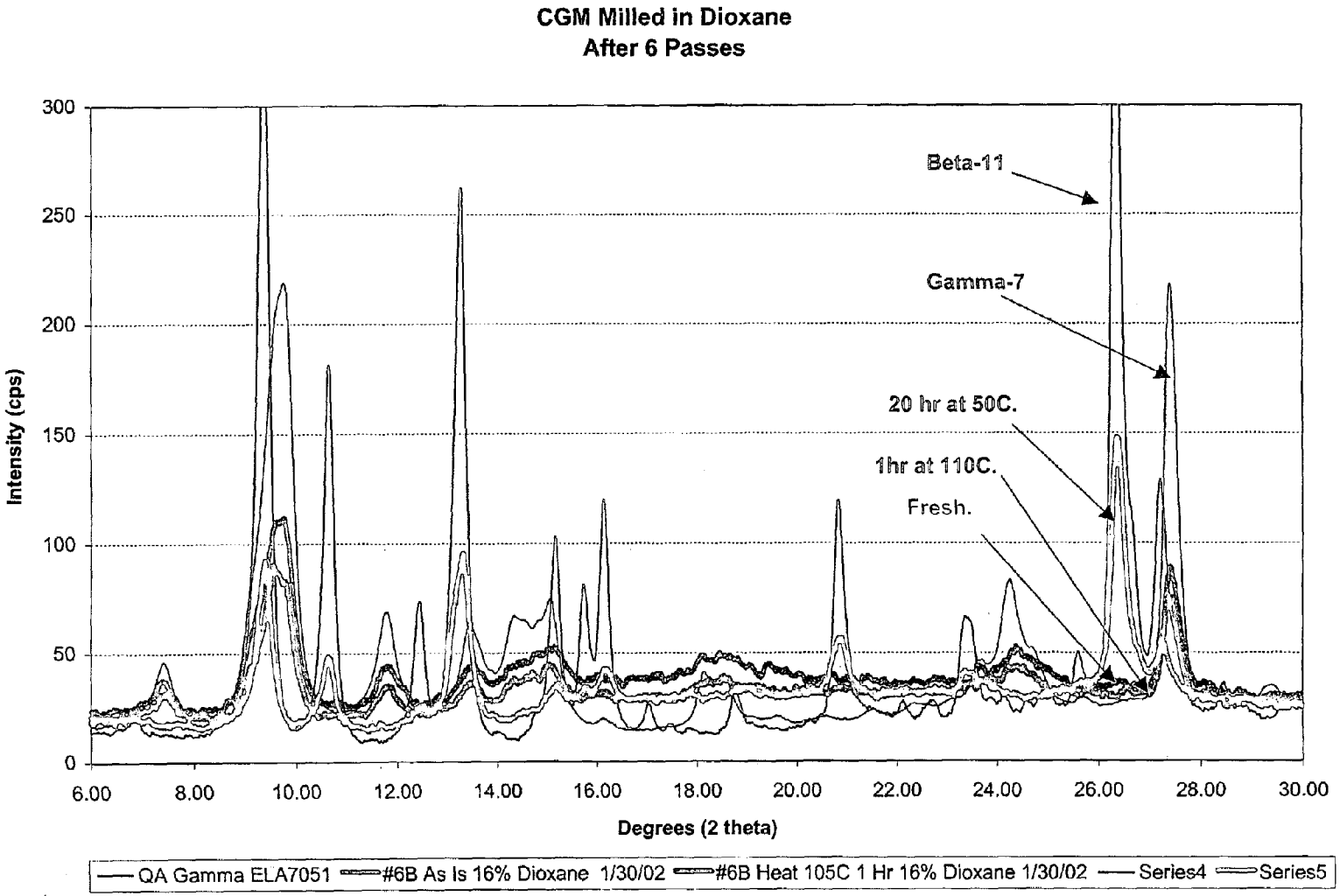
FIG. 13 shows X-ray diffraction spectrum of five samples of titanyl oxyphthalocyanine: three milled in pass mode with PCZ in dioxane after 6 passes and two of the three samples aged (20 hr @ 50C and 1 hr @ 110C), the data shown in Table 4.
Figure 14:
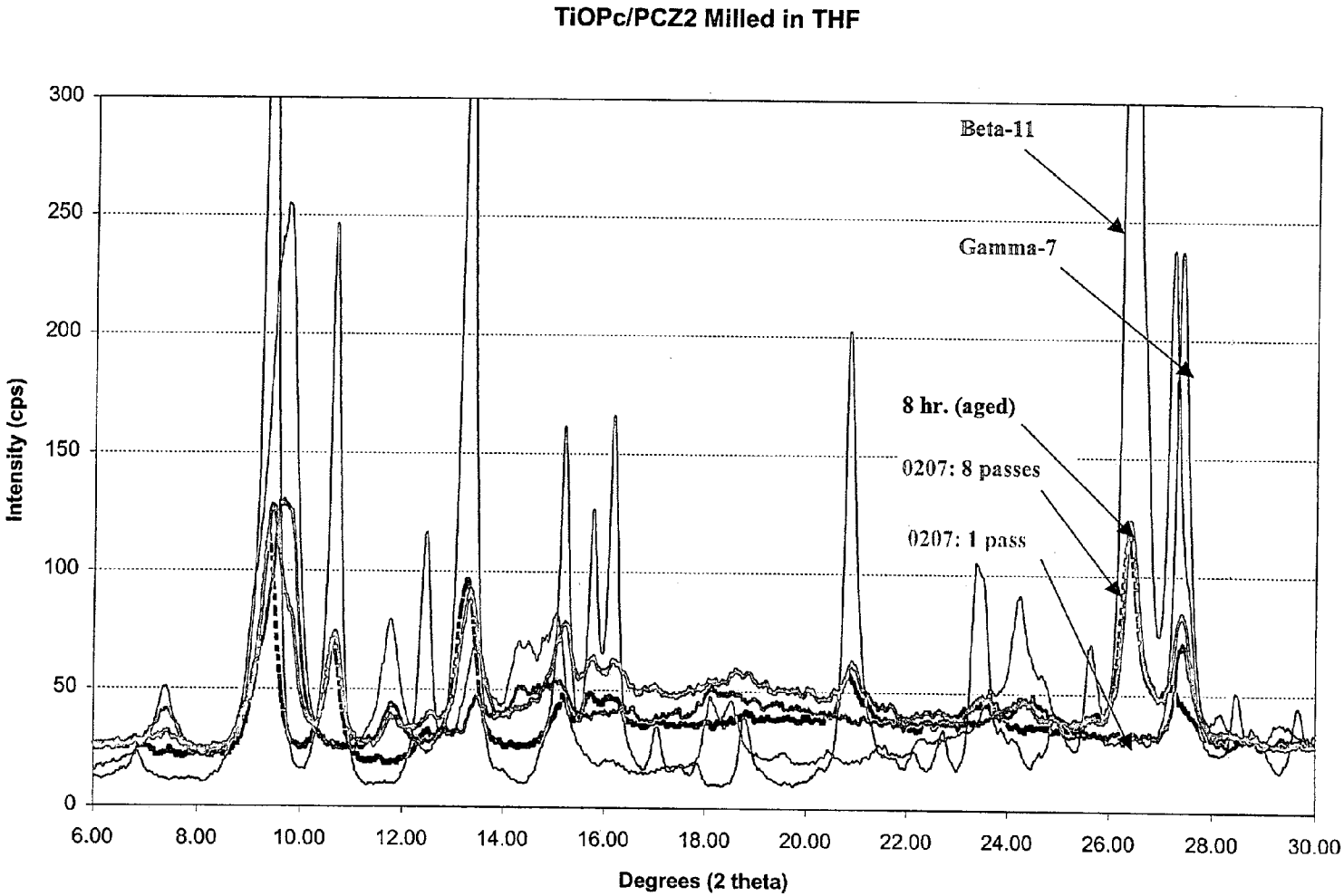
FIG. 14 shows X-ray diffraction spectrum of five samples of titanyl oxyphthalocyanine: three milled in pass mode with PCZ in tetrahydrofuran (THF), with one aged, the data shown in Tables 3 and 4.
Figure 15:
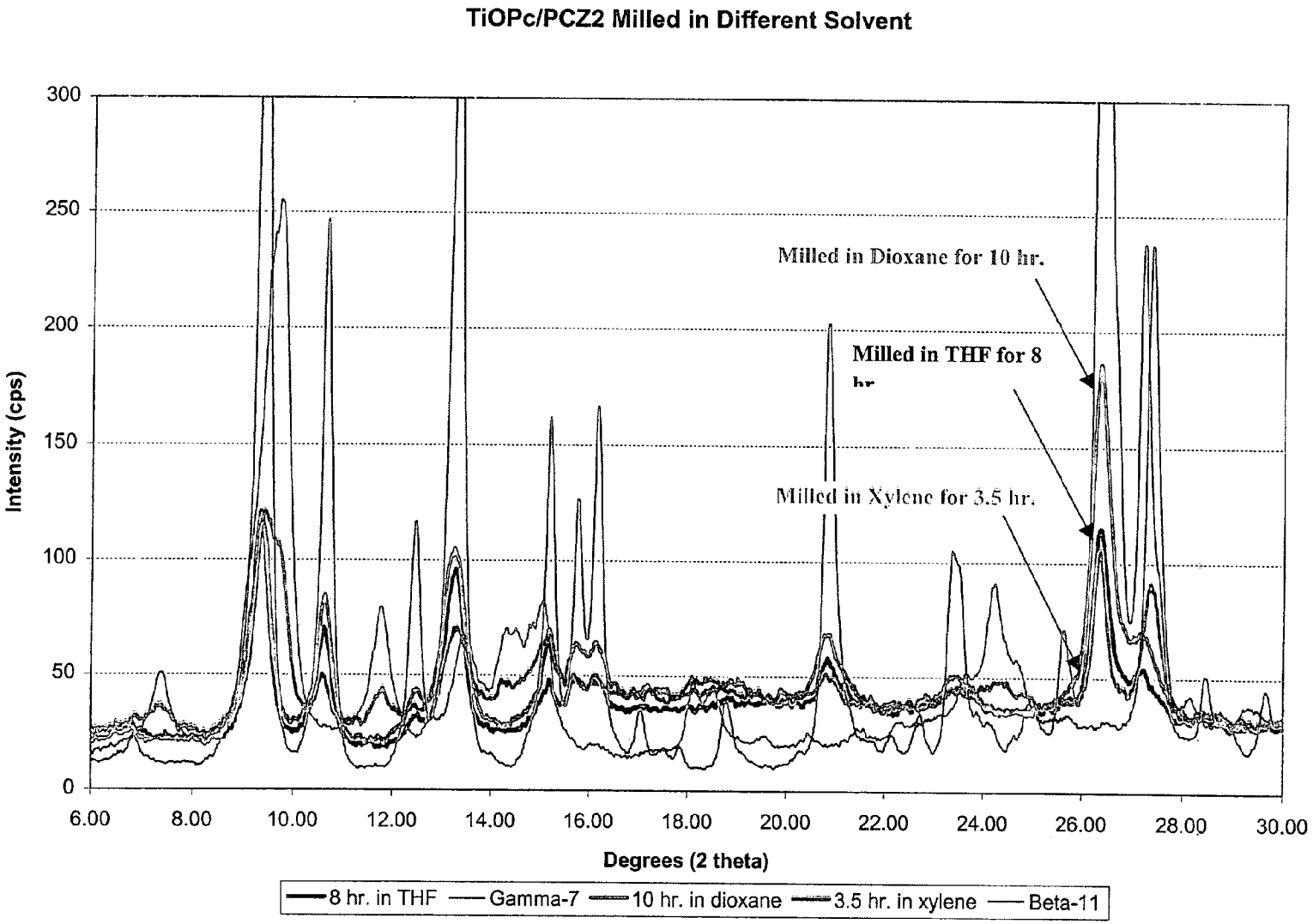
FIG. 15 shows X-ray diffraction data for five titanyl oxyphthalocyanine samples: three milled with PCZ in different solvents for different lengths of time, the data shown in Table 3 (beta and gamma curves not labeled).
Figure 16:
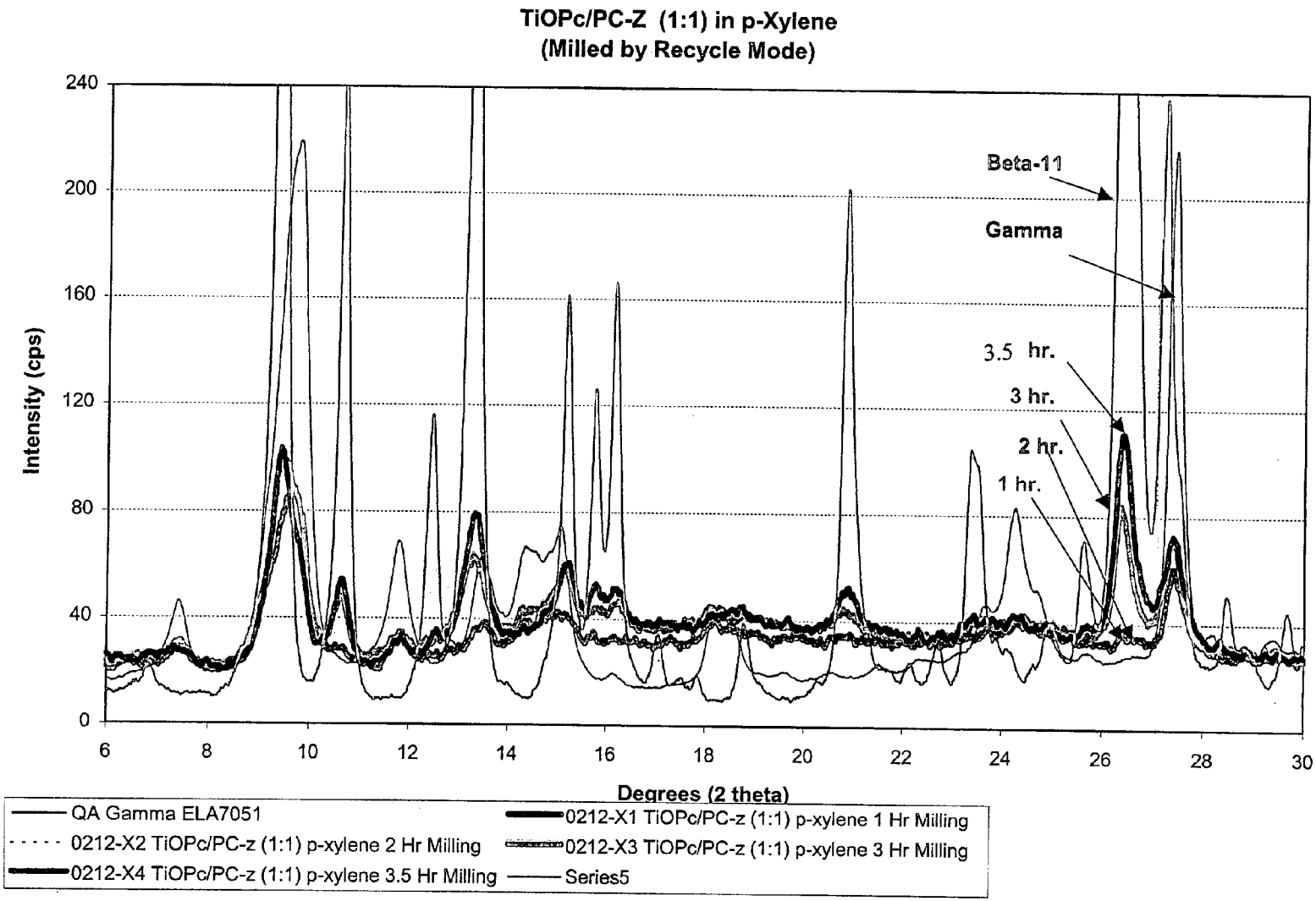
FIG. 16 shows X-ray diffraction spectrum of six samples of titanyl oxyphthalocyanine: four milled in recycle mode with PCZ in p-xylene for various lengths of time, the data shown in Table 3.
Figure 17:
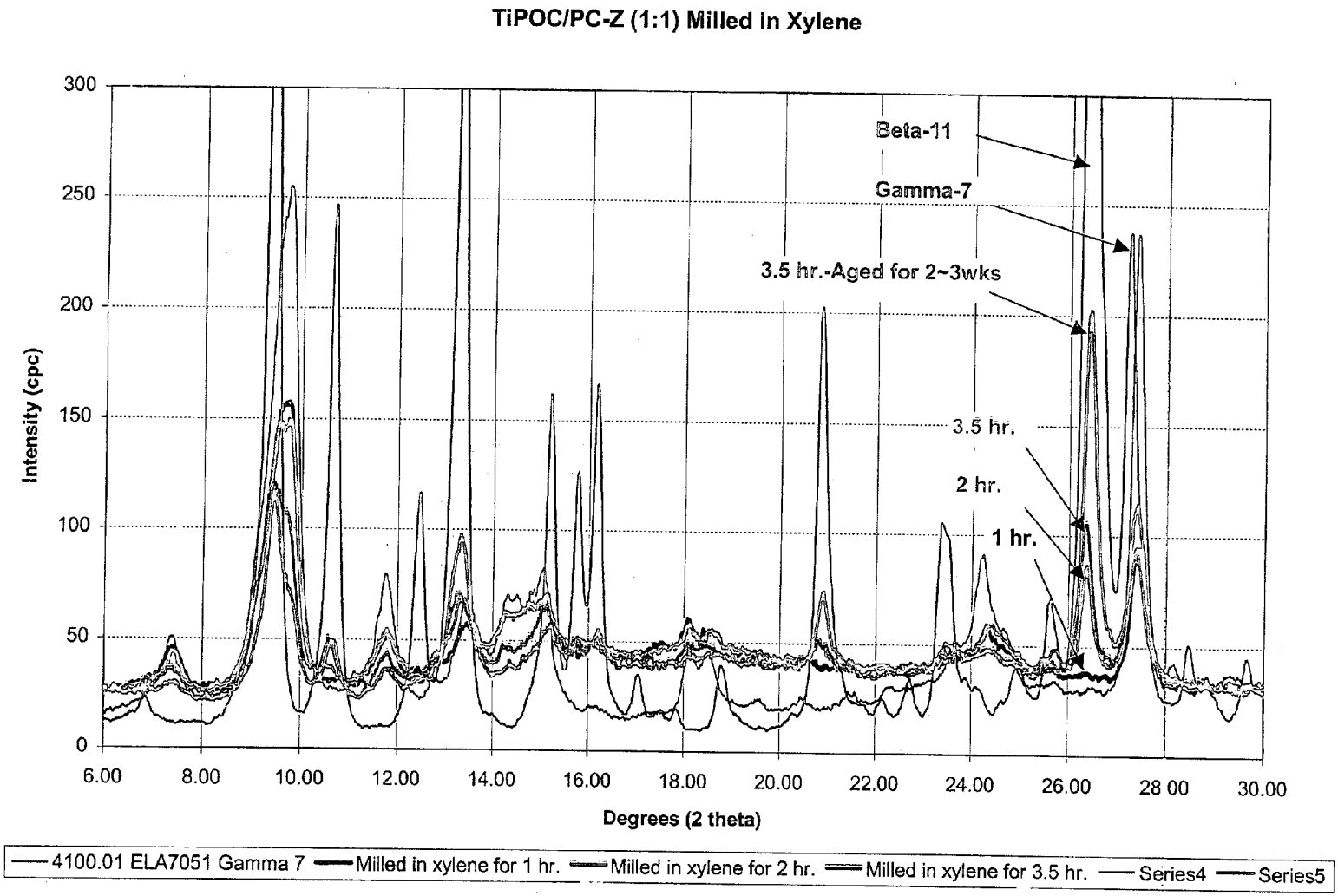
FIG. 17 shows X-ray diffraction spectrum of six samples of titanyl oxyphthalocyanine: four milled in recycle mode with PCZ in p-xylene for various lengths of time and one of these four samples aged for 2–3 weeks, the data shown in Table 3.

Representative embodiments of laminar structure of the electrophotosensitive member of the invention as shown in FIGS. 6*a* and 6*b*.

FIG. 6*a* shows an embodiment, wherein a photosensitive layer 1 is composed of a single layer and comprises a charge-generating material 2 and a charge-transporting material (not shown) together. The photosensitive layer 1 may be disposed on an electroconductive support 3. FIG. 6*b* shows an embodiment of laminated structure wherein a photosensitive layer 1 comprises a charge generation layer 4 comprising a charge-generating material 2 and a charge transport layer 5 comprising a charge-transporting material (not shown) disposed on the charge generation layer 4; and the charge transport layer 5 may be disposed on an electroconductive support 3. The charge generation layer 4 and the charge transport layer 5 can be disposed in reverse. In production of the electrophotosensitive member, the electroconductive support 3 may be a material having an electroconductivity including: a metal such as aluminum or stainless steel; and metal, plastic or paper having an electroconductive layer.

Between the electroconductive support 3 and the photosensitive layer 1, there can be formed a primer or undercoating layer having a barrier function and an adhesive function as an intermediate layer. The undercoating layer may comprise a substance, such as vinyl copolymers, polyvinyl alcohol, polyethylene oxide, ethyl cellulose, methyl cellulose, casein, polyamide, glue or gelatin. The above substance may be dissolved in an appropriate solvent and applied onto the electroconductive support 3 to prepare the primer layer. The thickness of the primer layer may be about 0.2–3.0 microns.

The photosensitive layer which is composed of a single layer as shown in FIG. 6*a* may be formed by mixing the charge-generating material comprising the titanium oxyphthalocyanine crystal used in the invention and the charge-transporting material with an appropriate solution containing a binder resin, applying the resultant coating liquid and then drying the coating.

The charge generation layer of the photosensitive layer having a laminated structure as shown in FIG. 6*b* may be formed by dispersing the charge-generating material comprising the titanium oxyphthalocyanine crystal used in the invention in an appropriate solution containing a binder resin, applying the resultant coating liquid and then drying the coating. It is possible not to use the binder resin in the above solution. The charge generation layer may also be formed by vapor deposition. Examples of the binder resin as described above may include: polyester, acrylic resins, polyvinylcarbazole, phenoxy resins, polycarbonate, polyvinyl butyral, polystyrene, vinyl acetate resins, polysulfone, polyarylate or vinylidene chloride-acrylonitrile copolymers.

The charge transport layer may be formed by dissolving a charge-transporting material and a binder resin in an appropriate solvent, applying the resultant coating liquid and then drying the coating. Examples of the charge-transporting material used may include: triaryl amine compounds, hydrazone compounds, stilbene compounds, pyrazoline compounds, oxazole compounds, thiazole compounds or triaryl methane compounds. As the binder resin, the above-mentioned resins can be used. The method for applying the photosensitive layer(s) may be: dipping, spray coating, spinner coating, bead coating, blade coating bar coating or beam coating.

In formulating the photosensitive layer, when the photosensitive layer is composed of a single layer, the charge-generating material and the charge-transporting material may preferably be contained in the photosensitive layer in amounts of 1–20 wt. % and 10–80 wt. %, respectively, particularly 2–10 wt. % and 30–70 wt. %, respectively. When the photosensitive layer has a laminated structure, the charge-generating material may preferably be contained in the charge generation layer in an amount of 5–80 wt. %, particularly 50–70 wt. %, and the charge-transporting material may preferably be contained in the charge transport layer in an amount of 30–80 wt. %, particularly 40–60 wt. %. The thickness of the photosensitive layer which is composed of a single layer may preferably be 5–40 microns, more preferably 10–30 microns. When the photosensitive layer has a laminated structure, the thickness of the charge generation layer may preferably be 0.01–10 microns, more preferably 0.05–5 microns and the thickness of the charge transport layer may preferably be 5–40 microns, more preferably 10–30 microns. In order to protect the photosensitive layer from external shock, a thin protective layer can be further disposed on the photosensitive layer.

When the titanium oxyphthalocyanine crystal is used as the charge-generating material, it is possible to mix the titanium oxyphthalocyanine crystal with another known charge-generating material as desired.

The electrophotosensitive member according to the present invention can be applied to not only a laser beam printer, a light-emitting diode (LED) printer and a cathode-ray tube (CRT) printer but also an ordinary electrophotographic copying machine, a facsimile machine and other applicable fields of electrophotography.

Figure 18:
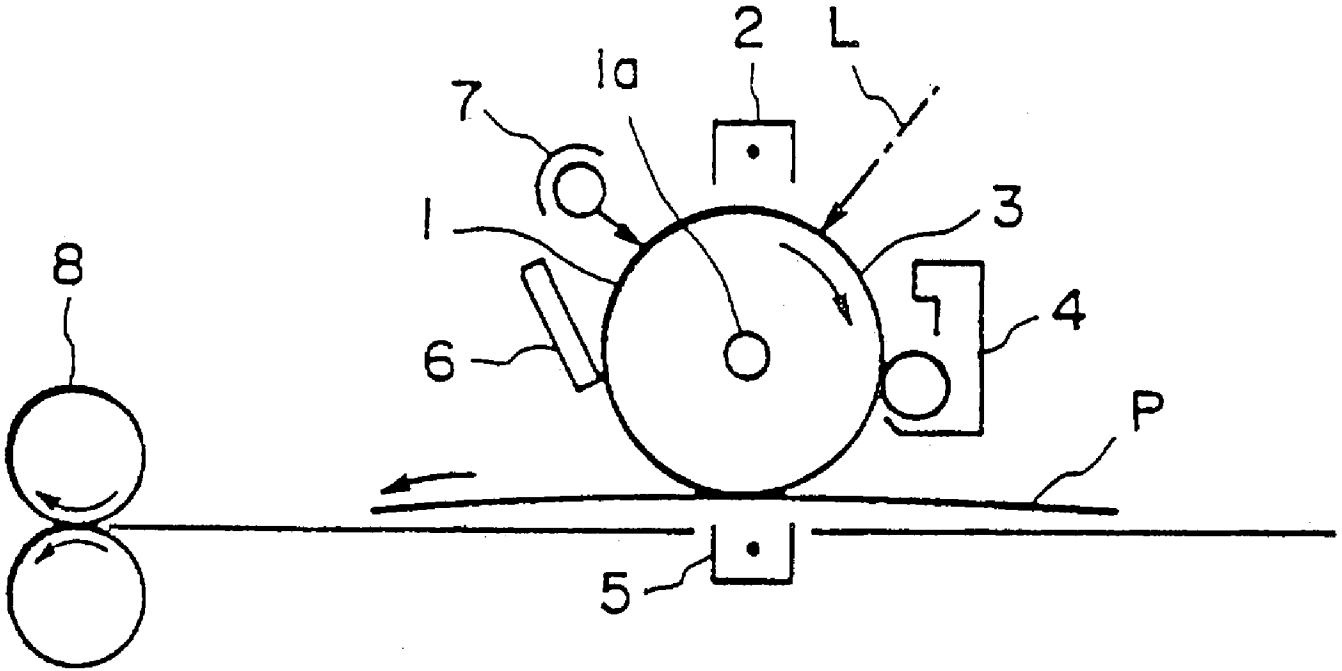
FIG. 18 shows a schematic of an imaging apparatus according to general practices that may incorporate the materials of the invention.
Figure 19:
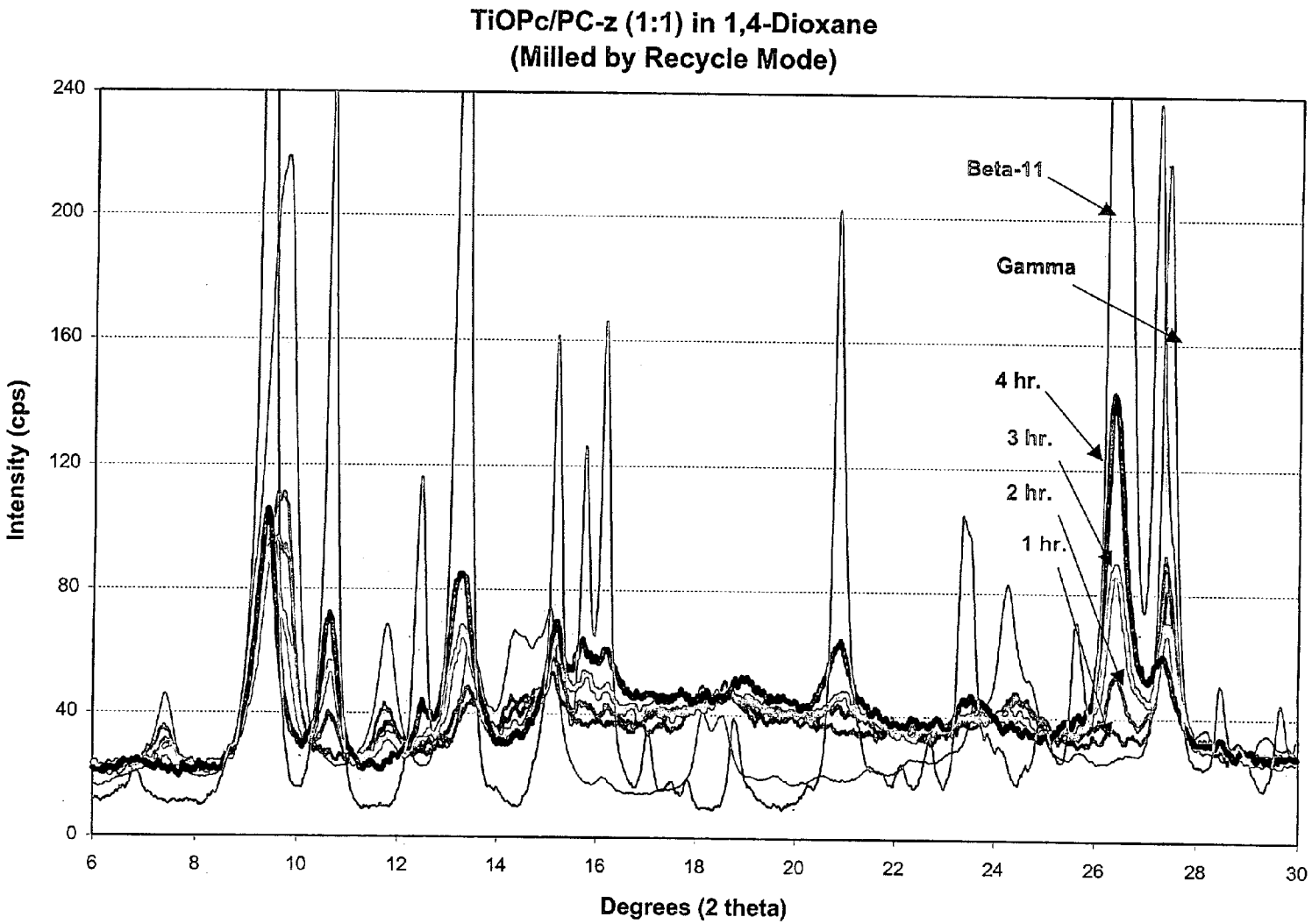
FIG. 19 shows X-ray diffraction patterns of six TiOPc samples: four milled in recycle mode with PCZ in 1,4-dioxane for various lengths of time, the data shown in Table 3.
Figure 20:
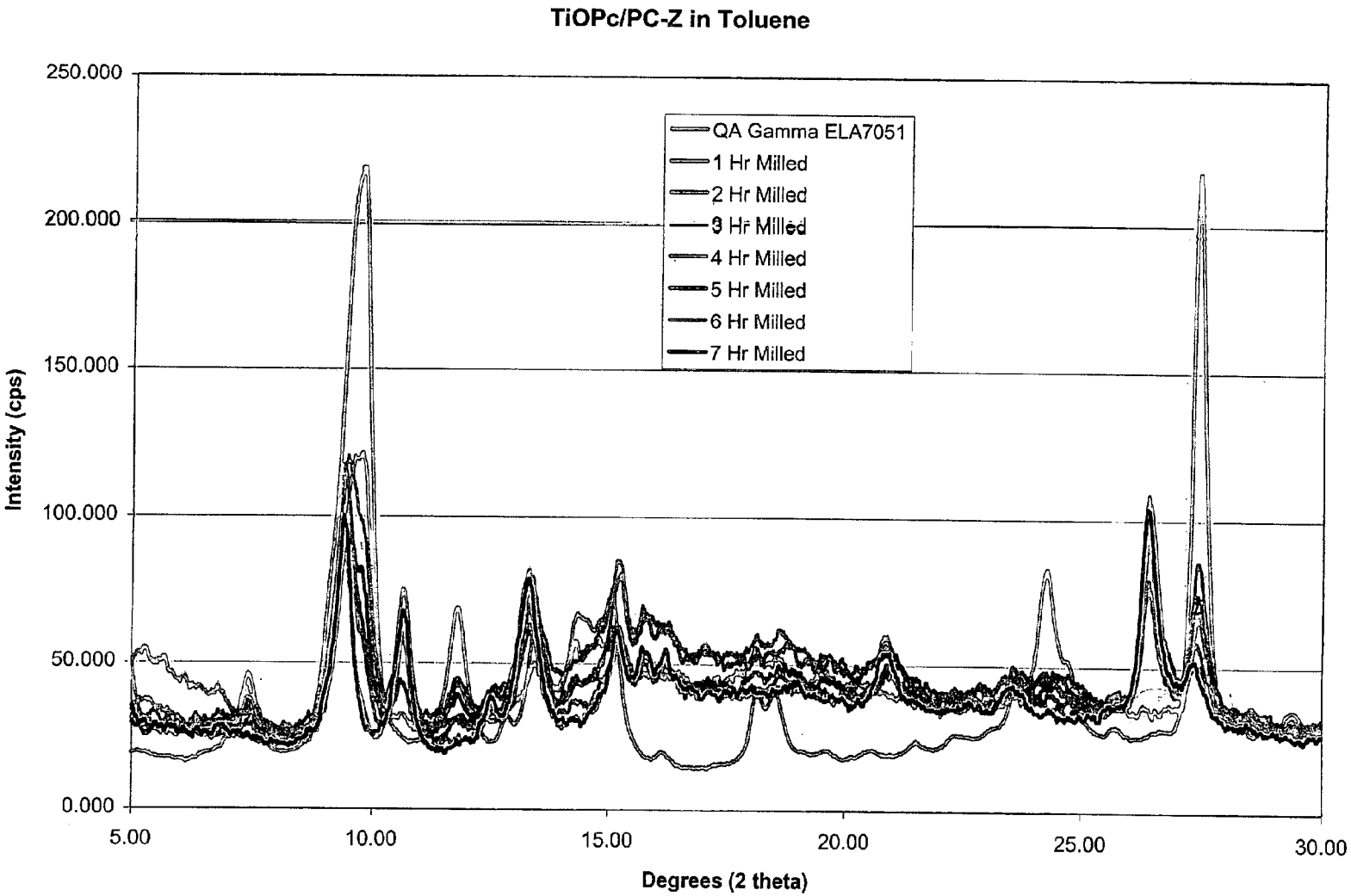
FIG. 20 shows X-ray diffraction patterns of eight TiOPc samples: seven milled in recycle mode for various lengths of time with PCZ in toluene.
Figure 21:
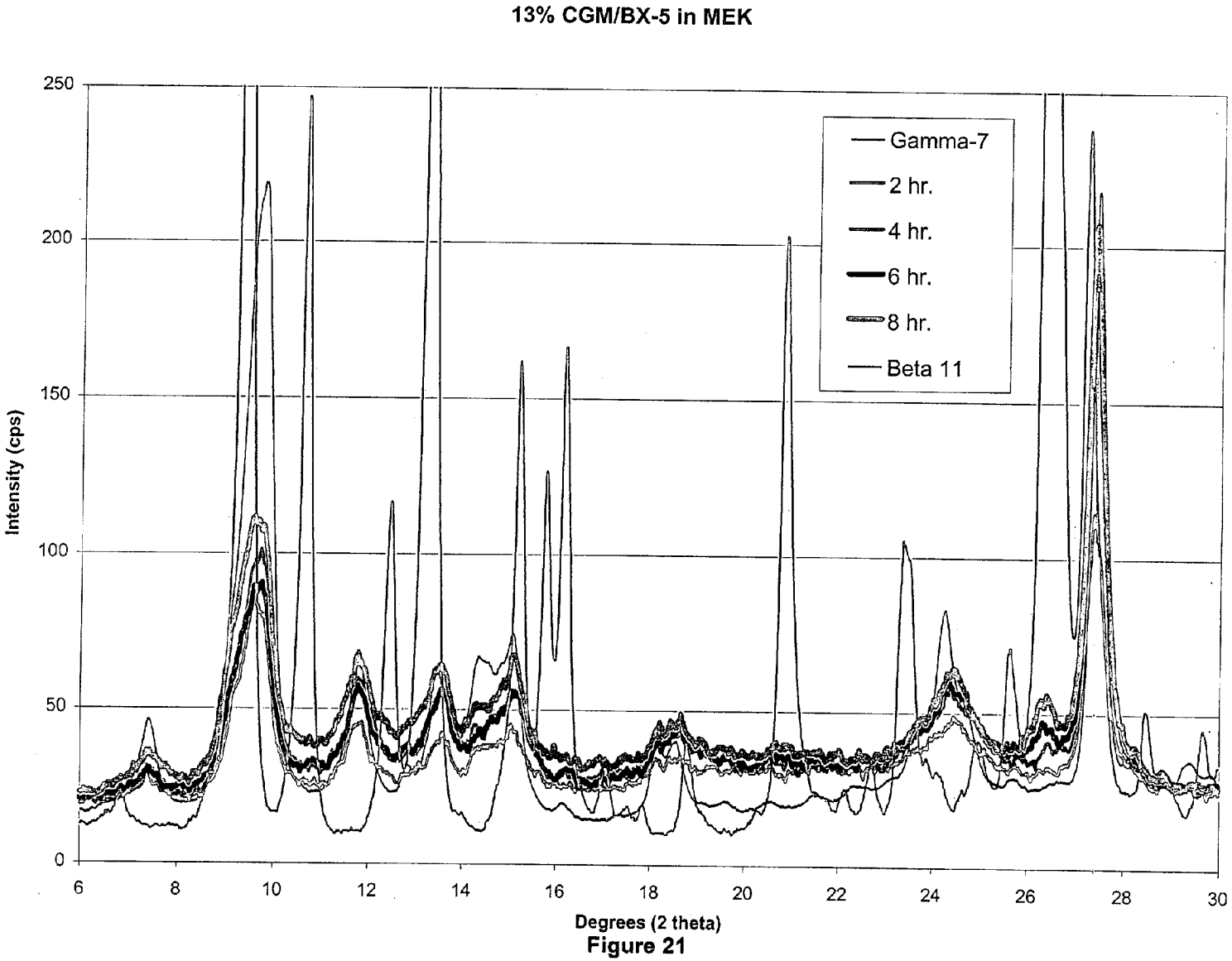
FIG. 21 shows X-ray diffraction patterns of six TiOPc samples: four milled in recycle mode for various lengths of time with BX-5 in methylethylketone.
Figure 22:
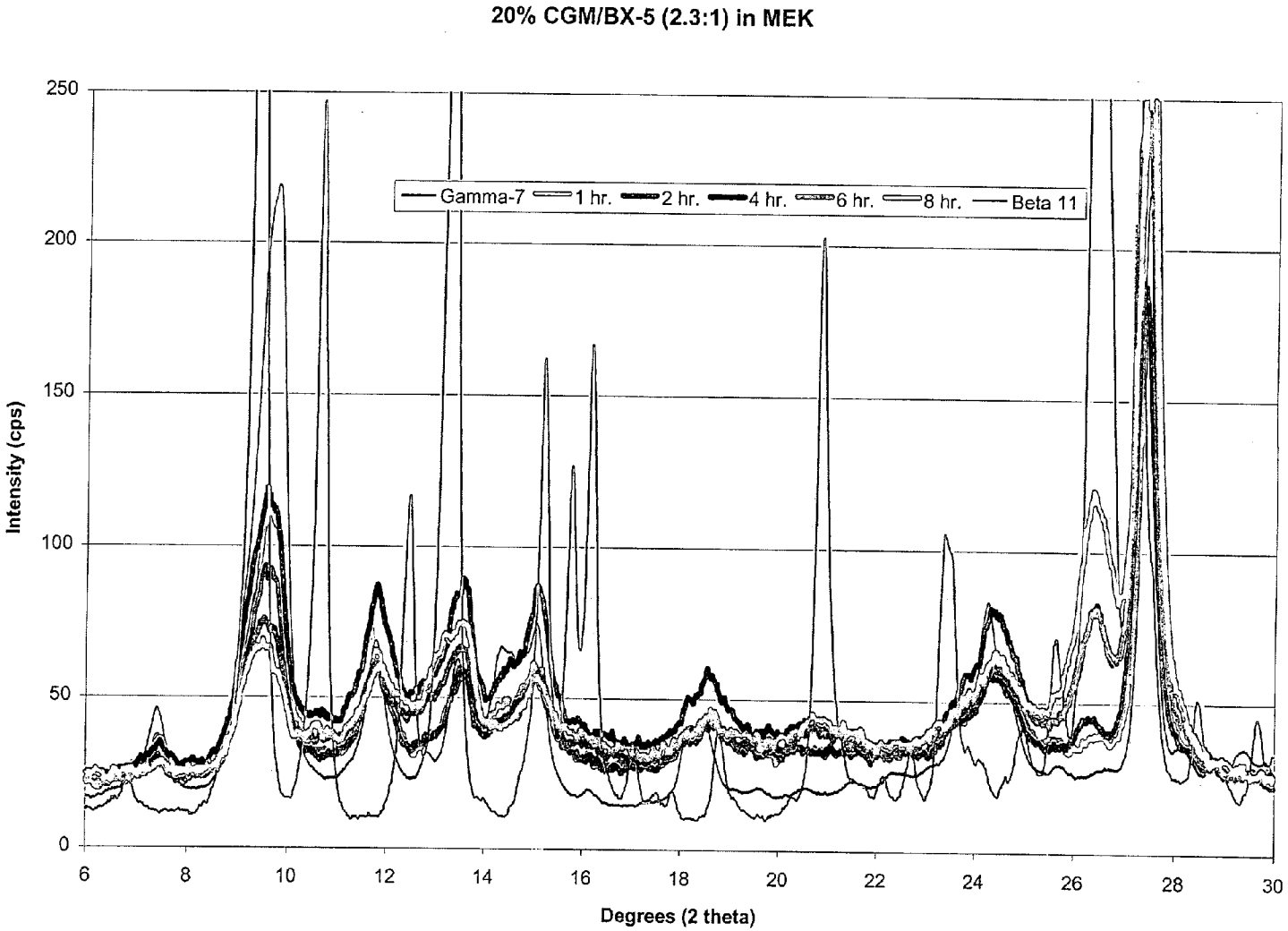
FIG. 22 shows X-ray diffraction patterns of seven TiOPc samples: five milled in recycle mode for various lengths of time with BX-5 in methylethylketone, the data shown in Table 2.
Figure 23:
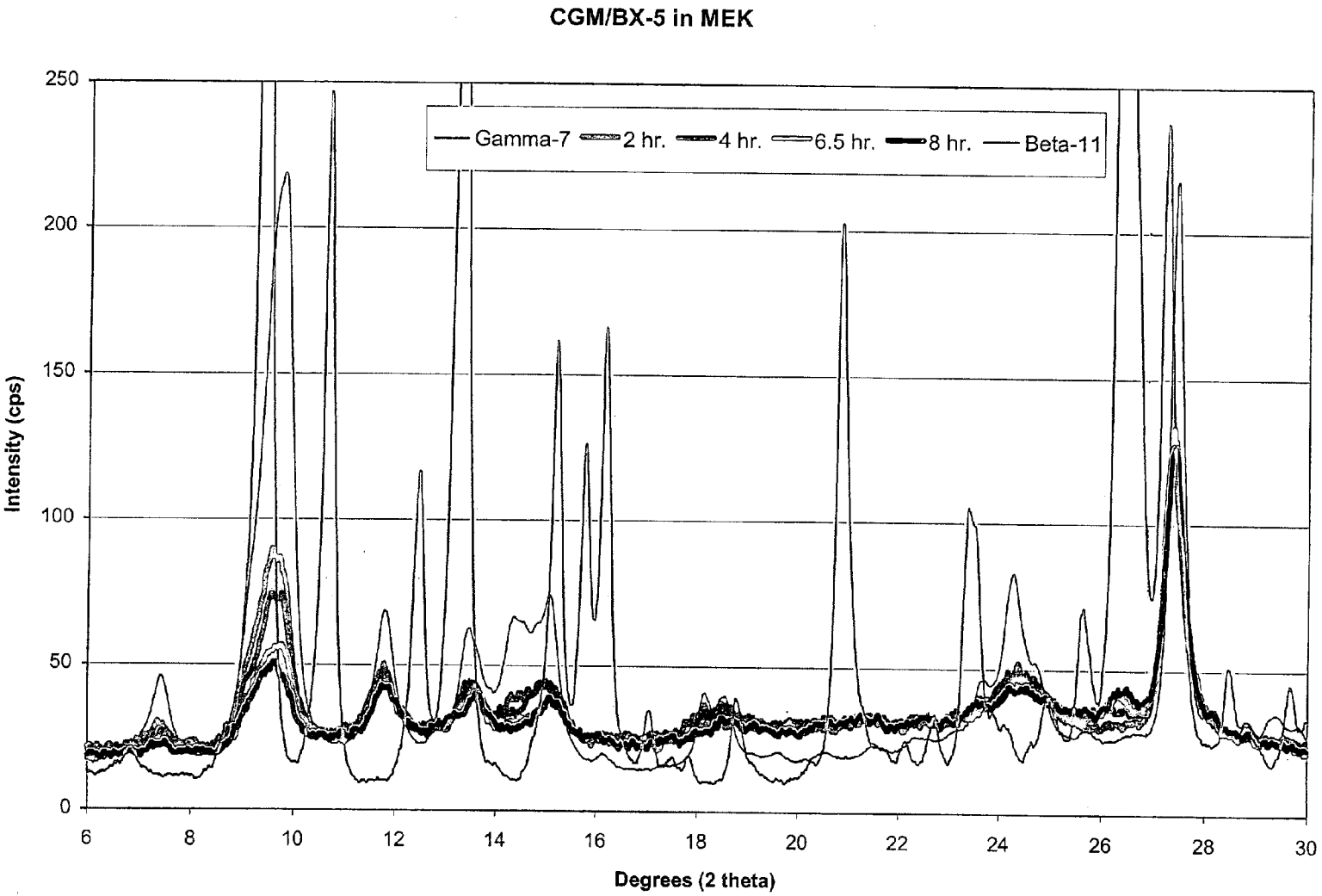
FIG. 23 shows X-ray diffraction patterns of six TiOPc samples: four milled in recycle mode for various lengths of time with BX-5 in methylethylketone.
Figure 24:
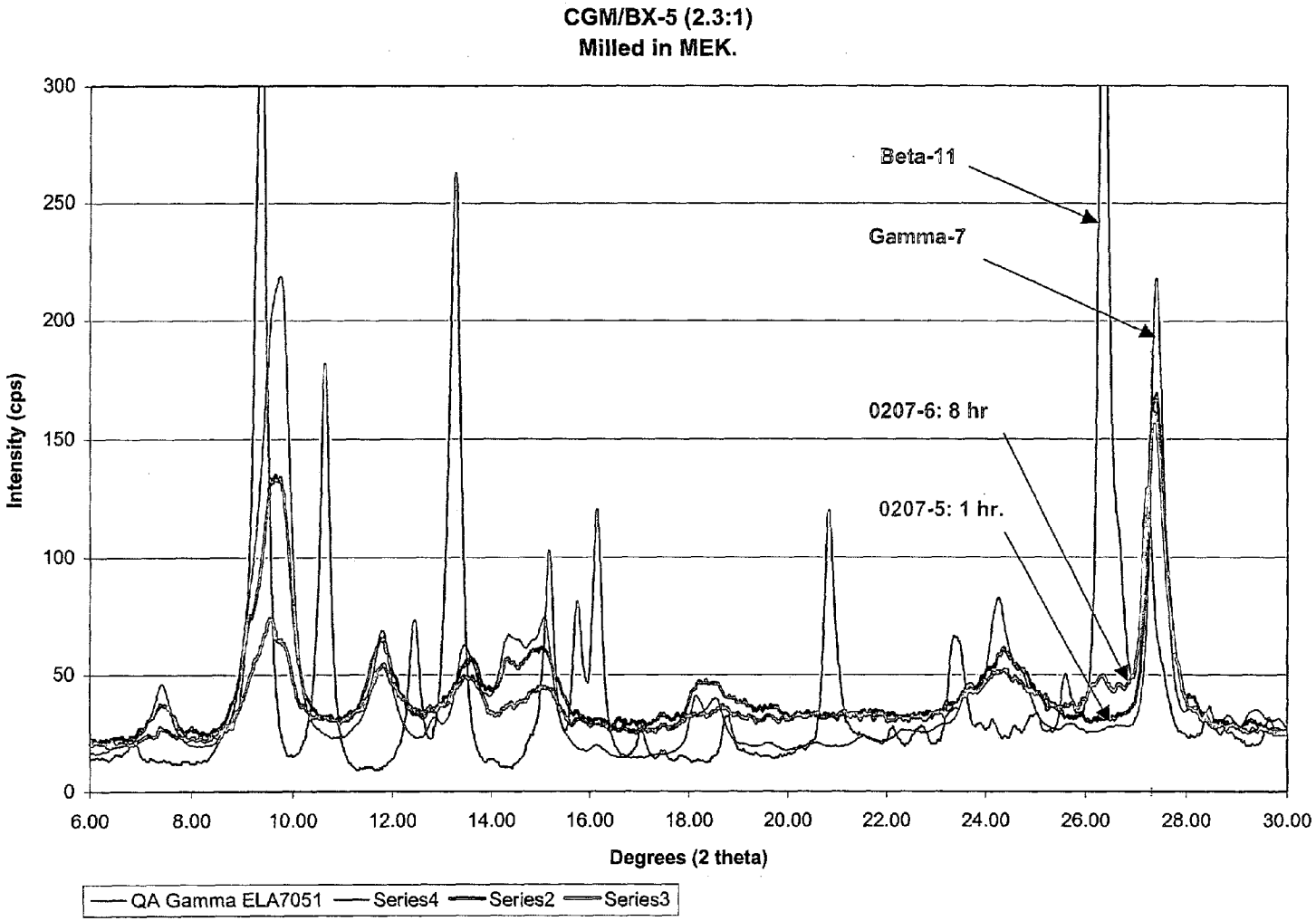
FIG. 24 shows X-ray diffraction patterns of four TiOPc samples: two milled in recycle mode for various lengths of time with BX-5 in methylethylketone, the data shown in Table 3.
Figure 25:
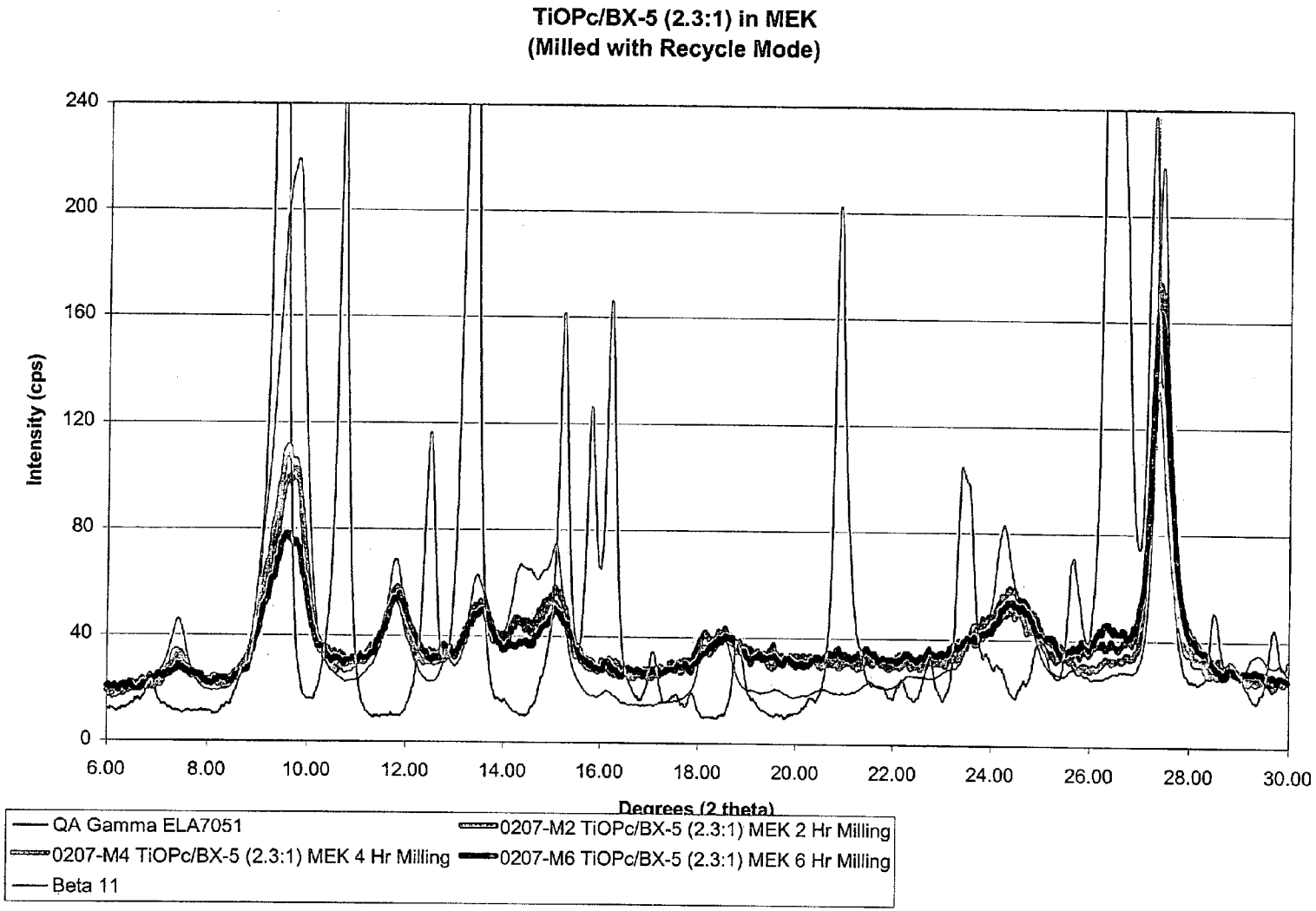
FIG. 25 shows X-ray diffraction patterns of five TiOPc samples: four milled in recycle mode for various lengths of time with BX-5 in methylethylketone, the data shown in Table 3.
Figure 26:
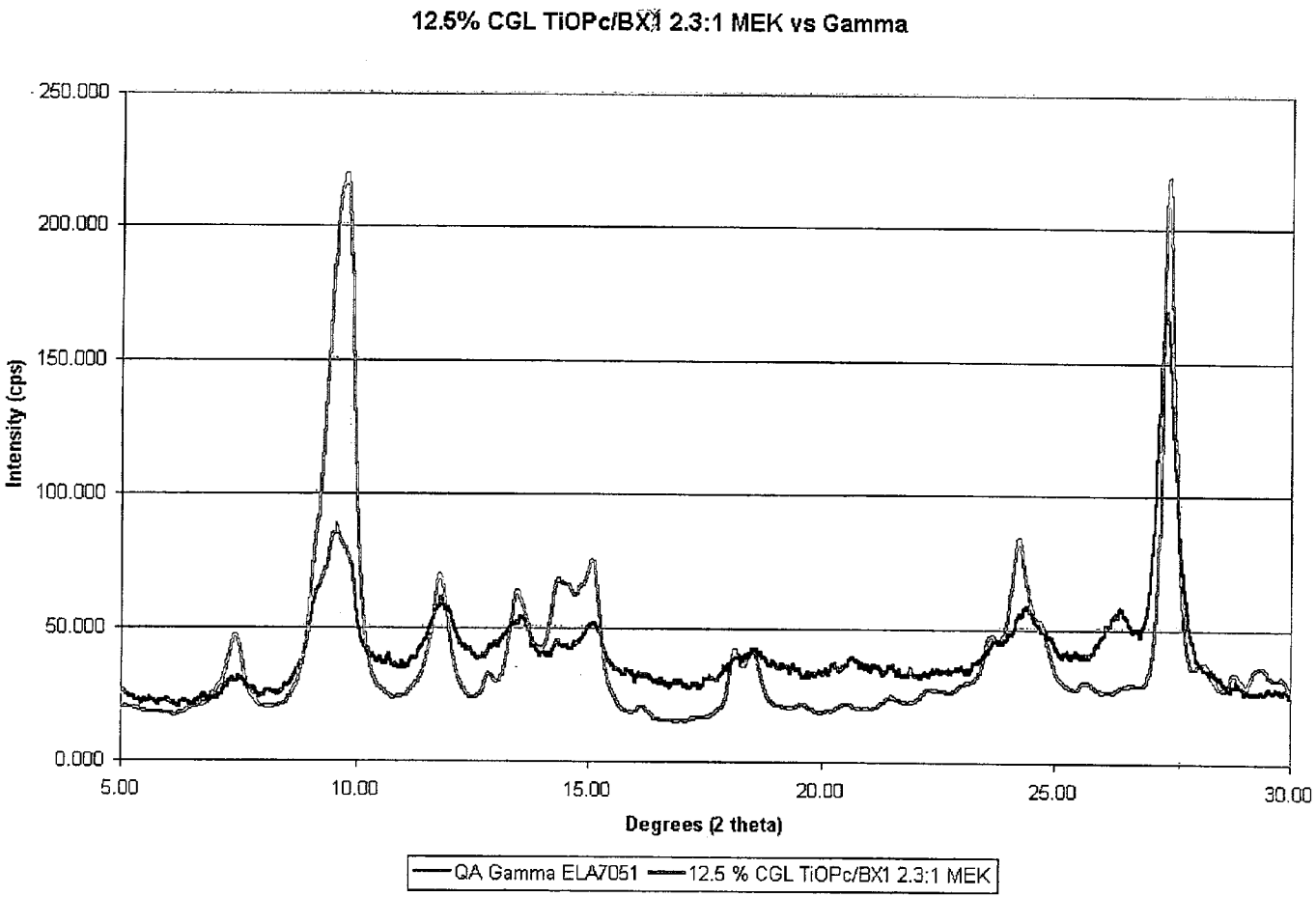
FIG. 26 shows X-ray diffraction patterns of two TiOPc samples: one milled in recycle mode for 8 hr with BX-1 in methylethylketone., the data shown in Table 3.
Figure 27:
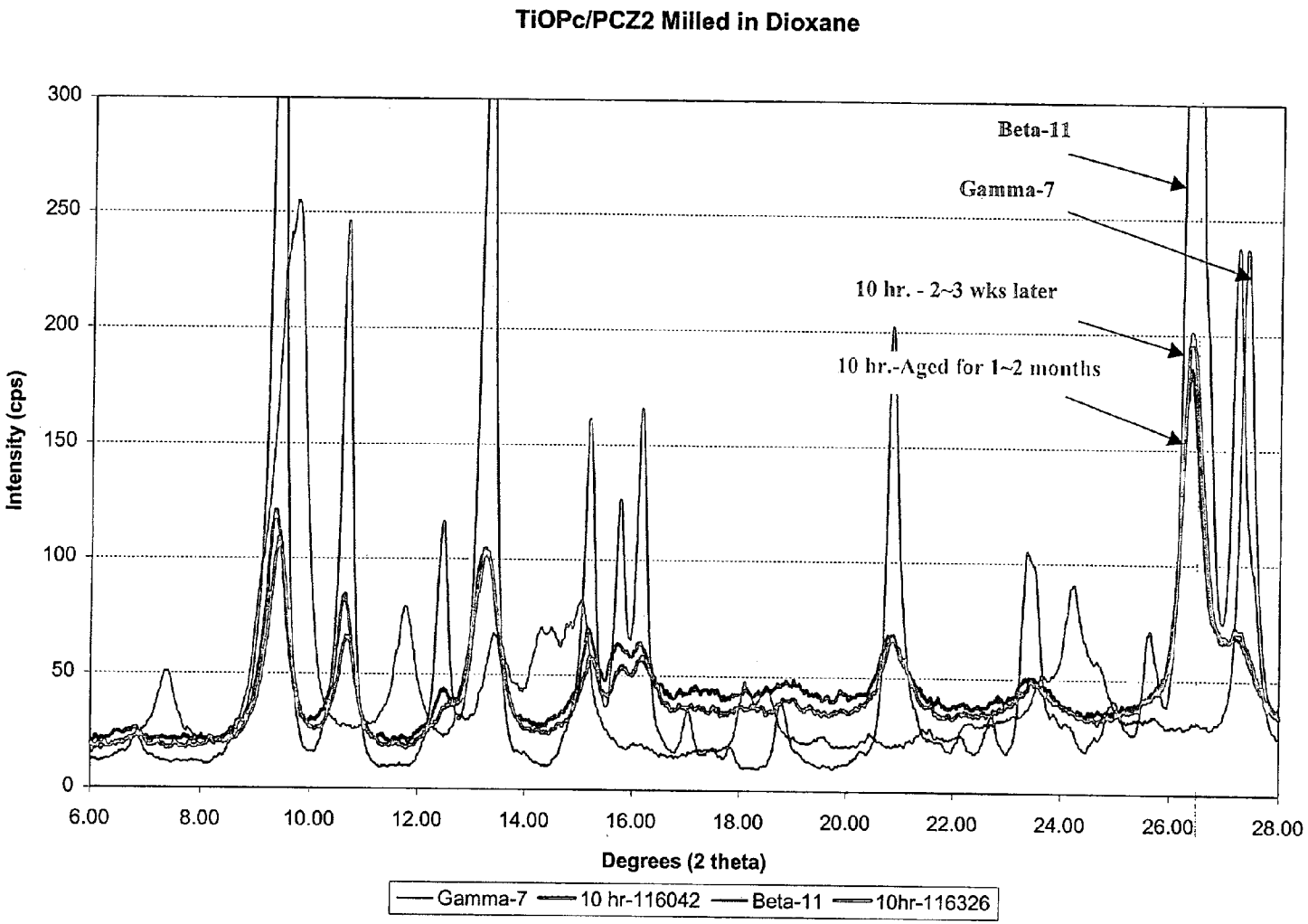
FIG. 27 shows X-ray diffraction patterns of four TiOPc samples, two milled with PCZ in dioxane and aged for various length of time at RT, the data shown in Table 3.
Figure 28:
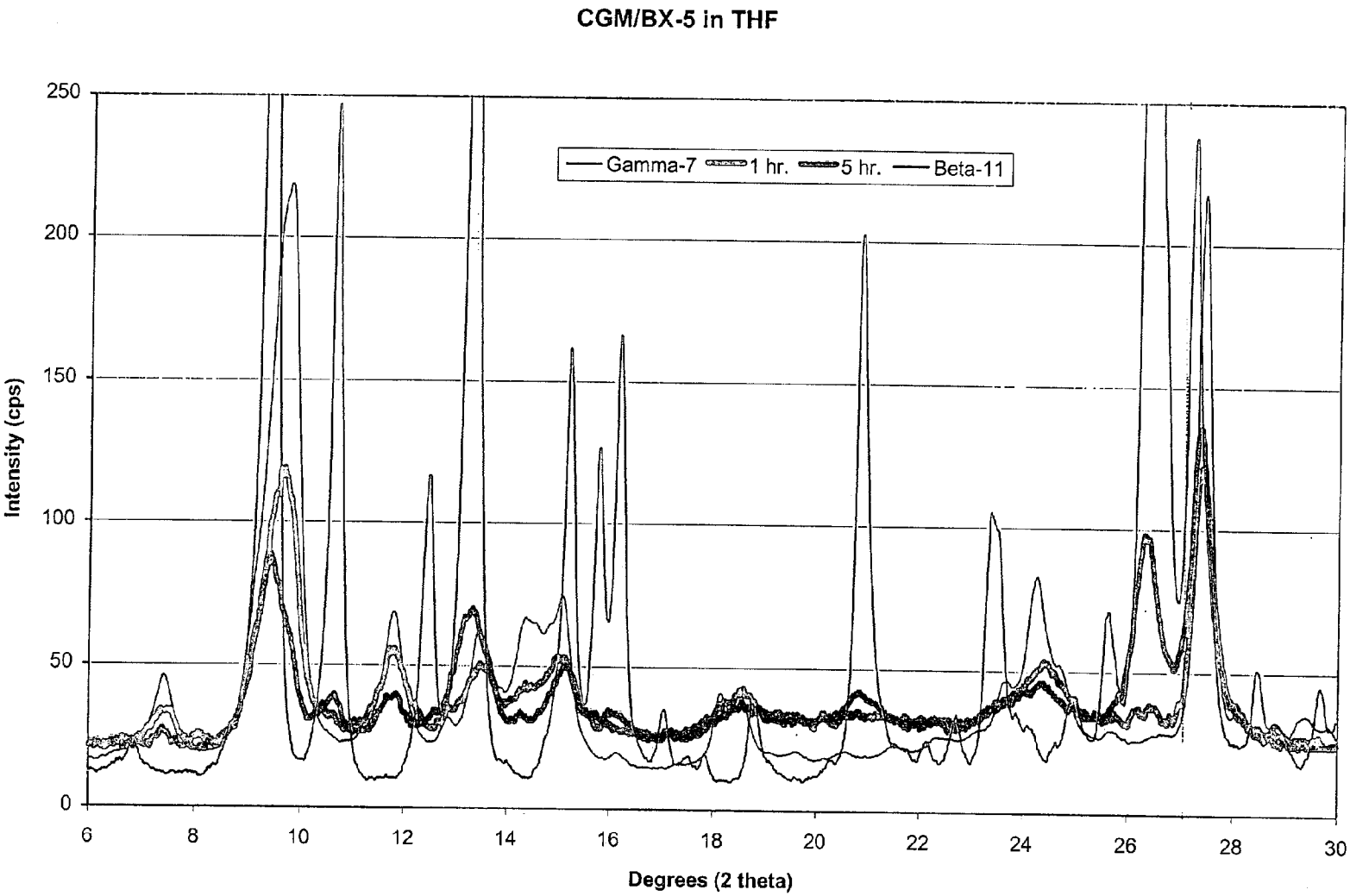
FIG. 28 shows X-ray diffraction patterns of four TiOPc samples: two milled in recycle mode for various lengths of time with BX-5 in tetrahydrofuran.
Figure 29:
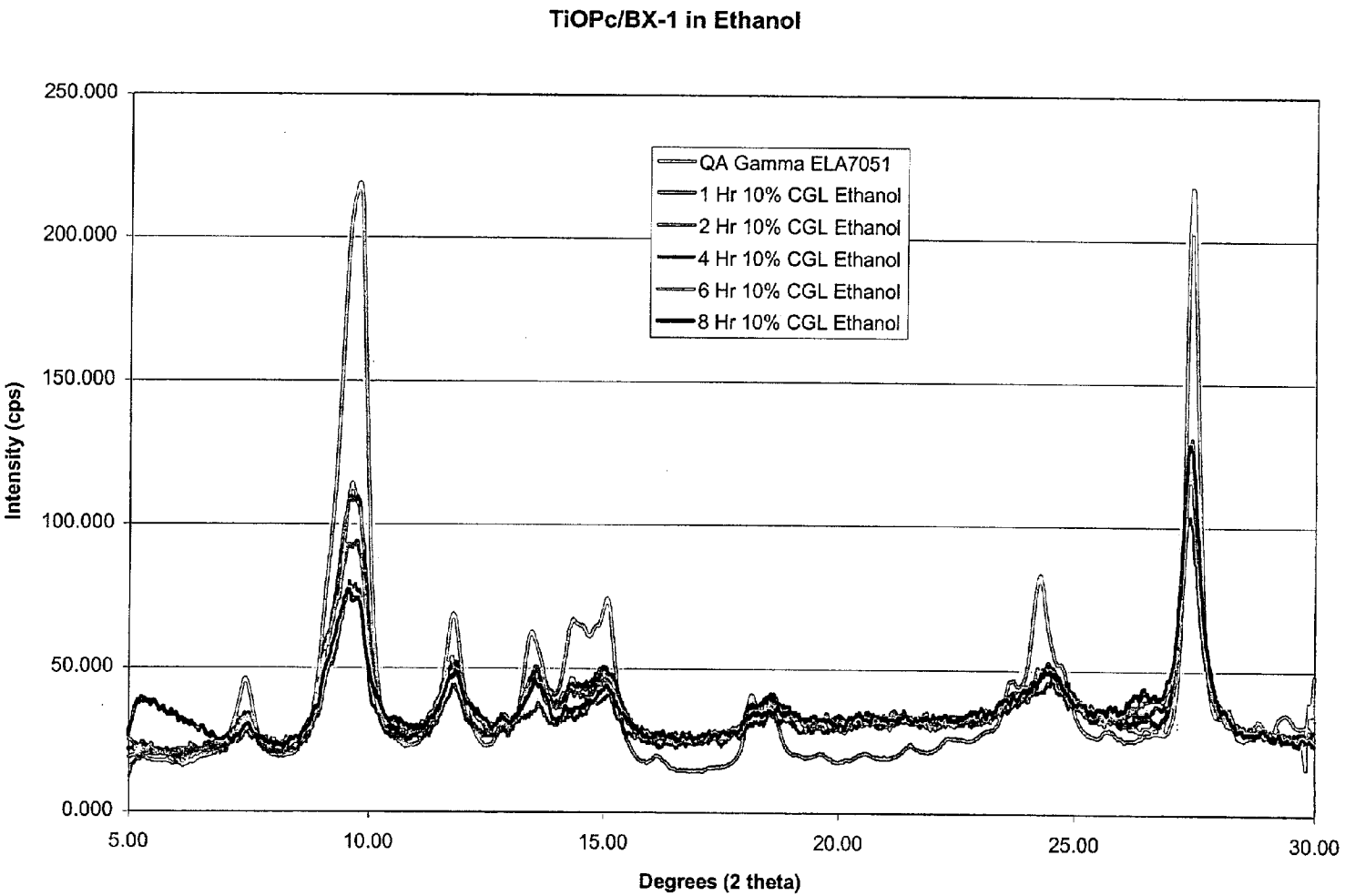
FIG. 29 shows X-ray diffraction patterns of six TiOPc samples: five samples milled in recycle mode for various lengths of time with BX-1 (polyvinyl butyral) in ethanol.

FIG. 18 shows a schematic structural view of an ordinary transfer-type electrophotographic apparatus using an electrophotosensitive member of the invention. Referring to FIG. 18, a photosensitive drum (i.e., photosensitive member) 1 as an image-carrying member is rotated about an axis 1*a* at a prescribed peripheral speed in the direction of the arrow shown inside of the photosensitive drum 1. The surface of the photosensitive drum is uniformly charged by means of a charger 2 to have a prescribed positive or negative potential. The photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

When forming a photosensitive layer of the two-layer composition, a carrier generating layer 2 can be provided by the following methods:

(a) By coating a solution formed by dissolving carrier generating substance in some proper solvent or adding binder to it and mixing, or (b) By coating a dispersing solution formed by grinding the carrier generating substance into fine particles with the appropriate devices, conditions and/or solvents (optionally in a dispersive medium) and adding binder if necessary and mixing, dispersing and coating.

Uniform dispersion is possible by dispersing particles under supersonic waves when using these methods. For solvent or dispersive medium used to form the carrier generating layer during coating, n-buthylamine, diethylamine, isopropanolamine, triethanolamine, triethylene diamine, N,N-dimethylformamide, acetone, methyl ethyl ketone, cyclohexanone, benzene, toluene, xylene, chloroform, 1,2-dichloroethane, dichloromethane, tetrahydrofuran, dioxane, methanol, ethanol, isopropanol, ethyl acetate, butyl acetate, dimethyl sulfoxide, etc. can be used, by way of non-limiting examples.

When a binder is used to form the carrier generating layer or carrier transporting layer, it may be any type but especially high molecular polymer which has ability to form hydrophobic insulated film of high dielectric constant is desirable. Such polymers include, by way of non-limiting examples, at least the following binders, but are not limited thereto: (a) Polycarbonate (especially Polycarbonate Z resin), (b) Polyester, (c) Methacrylic resins, (d) Acrylic resins, (e) polyvinyl resins, such as Polyvinyl chloride, Polyvinylidene chloride, Polyvinyl acetate, Polyvinyl butyral, (f) Polystyrene, (g) Styrene-butadiene copolymer, styrene-butadiene-acrylonitrile terpolymers, (h) Vinylidene chloride-acrylonitrile copolymers, (i) Vinyl chloride-vinyl acetate copolymer, (j) Vinyl chloride-vinyl acetate-maleic anhydride copolymer, (k) Silicone resin, (l) Silicone-alkyd resin, (m) Phenol-formaldehyde resin, (n) Styrene-alkyd resin, and (o) Poly-N-vinyl carbazole. Both homopolymers and copolymers (with at least two or more comonomeric components), graft copolymers, block copolymers, and the like may be used. The proportions of the binder may vary widely, depending upon the ultimate use, for example, the binder may be from 10–600 weight percent, desirably 50–400 weight percent in proportion to the charge generating material of the invention, and the carrier transporting substance desirably 10–500 weight percent on the same weight basis to the charge generating material. The thickness of the carrier generating layer formed in this way is desirably between about 0.01–20 micrometers and more desirably between 0.05–5 micrometers and the thickness of the carrier transporting layer is about 2–100 micrometers, more desirably between about 3–30 micrometers.

When the above carrier generating substance is dispersed to form a photosensitive layer, it is desirable that the said carrier generating substance has particles with average diameters or major dimensions less then 10, less than 8, less than 5, less than 4, less than 3, or less than 2 micrometers, desirably less than 1 micrometers or less than 0.8 or less than 0.5 um (a preferred target is less than about 0.3 um) in average particle size. When the particle size is too large, the particles cannot be dispersed satisfactorily into the layer and some of particles may be projected beyond the surface deteriorating the smoothness of the surface. In some case, discharge may be caused at the projected particles or toner particles may stick there, causing toner coating phenomenon.

In addition, the said photosensitive layer may contain one or more kinds of electron acceptance substances for the purposes of improving the sensitivity, and reducing the residual potential or fatigue when used repeatedly. For electron acceptance substances which can be used here, succinic anhydride, maleic anhydride, dibromo succinic anhydride, phthalic anhydride, tetrachloro phthalic anhydride, tetrabromo phthalic anhydride, 3-nitro phthalic anhydride, 4-nitro phthalic anhydride, pyromellitic anhydride, mellitic acid anhydride, tetracyanoetylene, tetracyanoquinodimethane, 0-dinitrobenzene, m-dinitrobenzene, 1,3,5-trinitrobenzene, paranitrobenzonitrile, picryl chloride, quinone chlorimide, chloranile, bulmanile dichlorodicyanoparabenzoquinone, anthraquinone, dinitroanthraquinone, 9-fluorenylidene malonodinitrile, polynitro-9-fluorenylidene malonodinitrile, picric acid, o-nitrobenzoic acid, p-nitrobenzoic acid, 3,5-dinitrobenzoic acid, pentafluorobenzoic acid, 5-dinitro salicylic acid, phthalic acid, mellitic acid, and other compounds of high electron affinity can be cited. The rate of electron acceptance substance is 100:0.01–200 for the carrier generating substance to electron acceptance substance in volume, desirably 100:0.1–100.

For the support to which the above photosensitive layer is provided, typical supports would include, by way of non-limiting examples, those that are formed by coating, evaporating or laminating metallic plate, metallic drum, or electric conductive polymer, indium oxide or other electric conductive compounds, or electric conductive thin layer composed of aluminum, palladium, gold, etc. to any base such films, sheets, drums, etc. of such non-limiting materials as fabric, paper, plastic film, composite, metallic, ceramic, etc. are used. For the intermediate layer which functions as an adhesive layer or barrier layer, etc., such ones that are composed of high molecular polymer as explained as above binder resin, polyvinyl alcohol, ethyl cellulose, carboxymethyl cellulose, and other organic high molecular substances or aluminum oxide, etc. are used.

Photoreceptors according to this invention are obtained as described above. They have such characteristics that are optimum as semiconductor laser photoreceptors since the maximum value of the titanyl oxyphthalocyanine used in this invention in the photosensitive wavelength region exits in 817 nm.+–0.5 nm and the titanyl oxyphthalocyanine has very stable crystal form so that inversion to other crystal forms is hard to occur. These characteristics are very advantageous to production and application of electrophotographic photoreceptors.

Two type of milling are used in the practices of the present invention. Other forms of milling may also be used. The two described forms are "recycle mode milling" and "pass mode milling." Recycle mode milling refers to a particle size reduction and/or pigment dispersion process in which a pigmented dispersion (a millbase, usually comprising a polymer and pigment) is placed in a vessel (the original vessel) and passed or treated (e.g., by pumping) continuously through the active milling zone of a milling chamber (e.g., the milling chamber of a horizontal sand mill), returning the treated millbase to the original vessel after exiting the milling chamber. Preferably the dispersion in the original vessel is agitated (e.g., by an axial mixer) to ensure homogeneity of the millbase throughout the milling process. In recycle mode milling, not every fluid element in the millbase is exposed to the same shear environment for the same residence time. However, the overall effect is to obtain a more uniform dispersion.

Pass mode milling refers to a particle size reduction and pigment dispersion process in which a pigmented dispersion (millbase) is placed in a first vessel, passed (e.g., by pumping) through the active milling zone of a milling chamber (e.g., the milling chamber of a horizontal sand mill), and collected in a second vessel. Pass mode milling ensures that every fluid element in the millbase is exposed to substantially the same shear environment for substantially the same residence time in the active milling zone. A milling pass is completed when substantially all of the millbase passes from the first vessel through the milling chamber and is collected in the second vessel. Subsequent milling passes may be effected by transferring the collected millbase from the second vessel to the first vessel after completion of the prior milling pass. Preferably the dispersion in the first milling vessel is agitated (e.g., by an axial mixer); more preferably, the dispersion is agitated in both the first and second vessel.

With this invention, photoreceptors of photosensitive wavelength region optimum to light of the middle wavelength region, and especially semiconductor lasers and LEDs can be obtained using original titanyl oxyphthalocyanine according to this invention. The titanyl oxyphthalocyanine according to this invention is excellent in crystal stability to solvents, heat, and mechanical straining force and high in sensitivity as photoreceptors, charging ability, and electric potential stability.

EXAMPLES

A) Formation and Detection of the Novel Crystal Form TiOPc

Details of the developments and investigations on novel crystal form (i.e., S-Form) TiOPc used for single layer OPC have been described above. The definition for S-form can be characterized by X-ray diffraction (XRD) showing all the major gamma-peaks plus a major non-gamma peak at 26.4 without showing any other major non-gamma peaks found in beta-form TiOPc. This establishes that the crystal lattice contains not only distributions of atoms/molecules in the lattice that are found in the gamma form, but also that additional lattice structure arrangements are present that are not consistent with the gamma-form, yet do not encompass all additional lattice structure (and hence not all of the XRD) consistent with the beta-form.

Listed in the Tables 1 and 2, attached below, are the results of peak areas in X-ray diffraction (XRD) for TiOPc powder (i.e., both gamma- and beta-form TiOPc) and for charge generating materials (CGM) mill-bases prepared from gamma form TiOPc with different binders in different solvents under different milling conditions and under different treatments.

It should be noted that the gamma-form TiOPc listed in Table-1 was ordered from H.W. Sands Corporation (Jupiter, Fla.) and was used for all the CGM millings listed in Table-2. While beta-9 and -11 listed in Table-1 were two different types of Beta-form TiOPc ordered from Syntec (Wolfen, Germany, 10/10.1 and 10/10.4) having different sensitivities of S(780 nm)=35, and 93 m2/J, respectively. Additional XRD data and discussion on TiOPc powder and with heat treatments are also provided above.

There are at least three different ways to obtain S-form TiOPc:

1) Milling with a Polymer Binder in a Selected Solvent Under Specified Milling Conditions As shown by the first two sets of examples in Table-2, S-form TiOPc can be obtained by milling the gamma-form TiOPc with a polyvinyl butyral resin (e.g., BX-5 from Sekisui Chemical Co. Ltd.) at 2.3:1 weight ratio in MEK using the recycle mode on a horizontal sand mill with 1-micron YTZ (yttria stabilized zirconia) beads (Morimura Bros., Inc., Fort Lee, N.J.). Depending on the percent of solids in the CGM mill-base, the conversion from gamma-form to S-form crystals were detected by XRD in samples after 6 hours of milling at 13% solids or after 1 hour but less than 6 hours of milling at 20% solids.

Storing in a refrigerator and/or adding dioxane or THF to the CGM mill-base of S-form TiOPc did not change the crystal form of the S-form TiOPc. The amount of solvent added to the CGM mill-base for XRD tests was equivalent to the amount used in single layer OPC coating solutions. Results of XRD on these samples were also listed in Table-2.

The other milling conditions listed in Table-2 (i.e., with different polymer binders in different solvents by either recycle mode or pass mode) resulted in CGM mill-bases with either gamma- or beta-form TiOPc.

2) Adding a Different Solvent to the CGM Mill-base of Gamma-form TiOPc

As shown by the third set of examples in Table-2 that S-form TiOPc can also be obtained by adding THF to the CGM mill-base of gamma-form TiOPc that was prepared by milling with BX-5 in 11% of ethyl acetate for 8 hours.

It should be noted that adding THF to other CGM mill-base of gamma-form TiOPc may not always change the crystal form of TiOPc from gamma to S-form. As mentioned earlier, the amount of solvent added to the CGM mill-bases for XRD tests were equivalent to the amount used in single layer OPC coating solutions.

3) Aging the CGM Mill-bases of Gamma-form TiOPc

As shown by the last three sets of examples in Table-2, S-form TiOPc can further be obtained as follows:

a. After aging in a refrigerator for one week (or less, although no XRD data available) for the CGM mill-bases of gamma-form TiOPc that were prepared by milling with polycarbonate-Z200 (ordered from Mitsubishi Engineering Plastics Corporation) in dioxane for 1 hr by using recycle mode or for 6 passes by using pass mode.

b. After aging at room temperature for three weeks (or less, although no XRD data available) the CGM mill-base that was prepared by milling with polycarbonate-Z200 in 22% of xylene for 4 passes by using pass mode.

It should be noted that the S-form TiOPc obtained by aging in a refrigerator for the CGM mill-base that was prepared by 6 passes of milling with polycarbonate-Z200 in dioxane was stable without showing any additional non-gamma peaks in XRD even after one month of storing in the refrigerator. While the S-form TiOPc obtained by aging in a refrigerator for the CGM mill-base that was prepared by 1 hour of milling with polycarbonate-Z200 showed up an additional non-gamma peak at 10.6 after 3 weeks of storing in a refrigerator.

It should also be noted heating the CGM mill-bases of gamma-form TiOPc may or may not change the crystal structures of TiOPc depending on the heating time and temperature on a specific CGM mill-base. Results and data on this preparation are shown in Table 4.

TABLE 1

Peak Areas in X-Ray Diffraction of TiOPc Powder

| | Non-Gamma Peaks | | | Overlap-Peak | | Gamma-Peaks | | Peak Ratios | | |
|---|---|---|---|---|---|---|---|---|---|---|
| Samples | S-10.6 | S-20.9 | S-26.4 | 9.7/9.4 | 27.4 | G-7.4 | G-11.8 | N26/Ot | N26/O9 | N26/O27 |
| Gamma(7) | 0 | 0 | 0 | 10476 | 4189 | 817 | 1918 | 0.00 | 0.00 | 0.00 |
| Beta-9 | 1991 | 7219 | 26244 | 6852 | 8060 | 0 | 0 | 1.76 | 3.83 | 3.26 |
| Beta-11 | 2817 | 1712 | 7098 | 6734 | 2269 | 0 | 0 | 0.79 | 1.05 | 3.13 |

FIG. 30 shows the visible absorption spectra of CGM samples obtained by milling the gamma-form TiOPc under three different milling conditions. The visible spectra of the milled sample whose XRD spectra was a) similar to the neat gamma-form TiOPc was designated as gamma, b) similar to neat beta-form TiOPc was designated as beta, and c) different from any neat TiOPc structure was designated as S-form TiOPc.

| Figure Label | Max. Peak Locations (+/− 10°) | | | | | | |
|---|---|---|---|---|---|---|---|
| Gamma | | | 790 | | 710 | | 630 |
| Beta | | 820 | | 750 | | 680 | 630 |
| S | 840 | | 790 | 750 | 710 | | 630 |

TABLE 2

Peak Areas in X-Ray Diffraction of CGM Mill-bases

| CGM Mill-Base | | Milling, | Non-Gamma Peaks (2θ) | | | Overlap-Peak (2θ) | | Gamma-Peaks (2θ) | | Peak Ratios | | | |
|---|---|---|---|---|---|---|---|---|---|---|---|---|---|
| Solvent | Binder | Aging, or Treatment | S-10.6° | S-20.9° | S-26.4° | 9.7°/9.4° | 27.4° | G-7.4° | G-11.8° | Nt/Gt | N26/Gt | N26/Ot | N26/O27 |
| 13% in | BX-5 | 1 hr | 0 | 0 | 0 | 5158 | 3729 | 349 | 1115 | 0.00 | 0.00 | 0.00 | 0.00 |
| MEK | 2.3:1 | 4 hr | 0 | 0 | 0 | 3304 | 3769 | 230 | 776 | 0.00 | 0.00 | 0.00 | 0.00 |

TABLE 2-continued

| CGM Mill-Base | | Milling, Aging, or Treatment | Peak Areas in X-Ray Diffraction of CGM Mill-bases: Non-Gamma Peaks (2θ) S-10.6° | S-20.9° | S-26.4° | Overlap-Peak (2θ) 9.7°/9.4° | 27.4° | Gamma-Peaks (2θ) G-7.4° | G-11.8° | Peak Ratios Nt/Gt | N26/Gt | N26/Ot | N26/O27 |
|---|---|---|---|---|---|---|---|---|---|---|---|---|---|
| | | 6 hr | 0 | 0 | 147 | 2688 | 3346 | 206 | 942 | 0.13 | 0.13 | 0.02 | 0.04 |
| | | 8 hr | 0 | 0 | 232 | 2046 | 3441 | 83 | 755 | 0.28 | 0.28 | 0.04 | 0.07 |
| | | RF for 1 month | 0 | 0 | 175 | 1186 | 2394 | 10 | 354 | 0.48 | 0.48 | 0.05 | 0.07 |
| | | Add Dx to 8 hr-RF | 0 | 0 | 288 | 1804 | 2074 | 75 | 481 | 0.52 | 0.52 | 0.07 | 0.14 |
| | | Add THF to 8 hr-RF | 0 | 0 | 881 | 3164 | 8089 | 207 | 828 | 0.85 | 0.85 | 0.08 | 0.11 |
| 20% in MEK | BX-5 2.3:1 | 1 hr | 8 | 0 | 65 | 4110 | 4094 | 222 | 1275 | 0.05 | 0.04 | 0.01 | 0.02 |
| | | 2 hr | 0 | 0 | 323 | 2990 | 4480 | 215 | 821 | 0.31 | 0.31 | 0.04 | 0.07 |
| | | 4 hr | 0 | 0 | 1666 | 4138 | 8741 | 128 | 1301 | 1.17 | 1.17 | 0.13 | 0.19 |
| | | 6 hr | 0 | 73 | 1561 | 2189 | 5814 | 0 | 609 | 2.68 | 2.56 | 0.20 | 0.27 |
| | | 8 hr | 36 | 122 | 3075 | 1680 | 7790 | 0 | 648 | 4.93 | 4.75 | 0.32 | 0.39 |
| 11% in EA | BX-5 1:1 | 8 hr | 29 | 0 | 11.5 | | 3700 | 261 | 565 | 0.05 | 0.01 | 0.00 | 0.00 |
| | | Add THF to 8 hr-RT | 0 | 0 | 752 | 4206 | 10796 | 343 | 1439 | 0.42 | 0.42 | 0.05 | 0.07 |
| | | Add THF to 8 hr-RT | 0 | 0 | 621 | 2208 | 5919 | 65 | 685 | 0.83 | 0.83 | 0.08 | 0.10 |
| 19% in Dx | PCZ 1:1 | 1 hr | 0 | 0 | 0 | 3763 | 1309 | 308 | 380 | 0.00 | 0.00 | 0.00 | 0.00 |
| | | 1 hr - RF 2 week | 0 | 0 | 186 | 6506 | 2323 | 638 | 857 | 0.12 | 0.12 | 0.02 | 0.08 |
| | | 1 hr - RF 3 week | 138 | 0 | 153 | 3016 | 1026 | 277 | 307 | 8.42 | 0.26 | 0.04 | 0.15 |
| | | 2 hr | 342 | 99 | 372 | 3275 | 1137 | 164 | 234 | 2.04 | 0.93 | 0.08 | 0.33 |
| 15% in Dx | PCZ 1:1 | 1P | 0 | 0 | 0 | 2276 | 604 | 222 | 250 | 0.00 | 0.00 | 0.00 | 0.00 |
| | | 6P | 0 | 0 | 0 | 4361 | 1265 | 325 | 507 | 0.00 | 0.00 | 0.00 | 0.00 |
| | | 6P - RT for 1 week | 182 | 100 | 347 | 4516 | 1556 | 298 | 515 | 0.77 | 0.43 | 0.06 | 0.22 |
| | | 6P-RF for 1 week | 0 | 0 | 217 | 4624 | 1867 | 224 | 581 | 0.27 | 0.27 | 0.03 | 0.12 |
| | | 6P-RF for 1 month | 0 | 0 | 124 | 3077 | 756 | 172 | 376 | 0.23 | 0.23 | 0.03 | 0.16 |
| | | Add THF to 6P-RF | 0 | 0 | 50 | 1383 | 246 | 84 | 128 | 0.24 | 0.24 | 0.03 | 0.20 |
| 22% in Xy | PCZ 1:1 | 4P | 0 | 0 | 0 | 4760 | 1169 | 349 | 454 | 0 | 0 | 0 | 0 |
| | | 4P-RT for ~3 weeks | 0 | 0 | 134 | 6977 | 1583 | 528 | 627 | 0.12 | 0.12 | 0.02 | 0.08 |

Note:

1) The solvents used for millings were methyl ethyl ketone (MEK), ethyl acetate (EA), 1,4-dioxane (Dx), or xylene (Xy). They were all commercially obtained from Sigma-Aldrich Chemical Co. in Milwaukee, WI.

2) The polymer binders used for milling were polyvinyl butyral (BX-5, commercially obtained from Sekisui Chemical Co. Ltd., Japan), or polycarbonate-Z200 (commercially obtained from Mitsubishi Engineering-Plastics Corporation, White Plains, NY).

3) The pigment to binder ratio for each CGM mill-base was indicated under the column for binders.

B. TiOPc in CGM Milled by Recycle-Mode

Gamma-TiOPc was obtained from H. W. Sands (Jupiter, Fla.) for the CGM milling by recycle-mode. It was milled with different polymer binders (i.e., PC-Z, BX-1, or BX-5) at different TiOPc/binder ratios and in different solvents (i.e., 1,4-dioxane, p-xylene, THF, MEK, and ethyl acetate). Listed in Table-3 on next page are data for different CGM mill-bases by recycle-mode along with peak areas from X-ray diffraction at the scanning angles of 7.4, 10.6, 11.8, 20.9, 26.4, and 27.4.

It should be noted that peaks at 7.4, 11.8, and 27.4 are observed in gamma-TiOPc as listed in Table-1 and as shown in FIG. 2 while peaks at 10.6, 20.9, and 26.4 were not observed in FIG. 2 for gamma-TiOPc, but were observed in FIG. 2 for beta-TiOPc. It should also be noted that the peak at 27.4 was an overlapped peak that was observed in both gamma-TiOPc and beta-TiOPc.

TABLE 3

CGM Milled by Recycle Mode

| CGM Mill-Base | | Milling | Ageing or | Non-Gamma Peaks (2θ) | | | M-Peak | Gamma-Peaks | | Peak Ratios | | |
|---|---|---|---|---|---|---|---|---|---|---|---|---|
| Solvent | Binder | hr | Treatment | 10.6° | 20.9° | 26.4° | 27.4° | G-7.4° | G-11.8° | Nt/Gt | N26/Gt | N26/P27 |
| 21%-Dx | PCZ | 10 | RT - 60D | 1130 | 769 | 5011 | 1005 | 0 | 0 | S Only | | 4.99 |
| 14%-Dx | 2:1 | | RT - 45D | 1587 | 873 | 4514 | 992 | 0 | 0 | S Only | | 4.55 |
| 19% in | PCZ | 1 | RF - 1D | 0 | 0 | 0 | 1309 | 308 | 380 | 0.00 | 0.00 | G |
| Dioxane | 1:1 | | | | | | | | | | | only |
| | | 2 | RF - 1D | 342 | 99 | 372 | 1137 | 164 | 234 | 2.04 | 0.93 | 0.33 |
| | | 3 | RF - 1D | 825 | 416 | 1642 | 1041 | 63 | 101 | 17.58 | 10.01 | 1.58 |
| | | 4 | RF - 1D | 1299 | 746 | 3057 | 737 | 21 | 40 | 83.64 | 50.11 | 4.15 |
| 18% in | PCZ | 1 | RT - 6D | 0 | 0 | 0 | 1302 | 468 | 609 | 0.00 | 0.00 | G |
| Xylene | 1:1 | | | | | | | | | | | only |
| | | 2 | RT - 6D | 176 | 136 | 888 | 1853 | 406 | 388 | 1.51 | 1.12 | 0.48 |
| | | 3.5 | RT - 7D | 397 | 133 | 1450 | 1601 | 192 | 289 | 4.12 | 3.01 | 0.91 |
| | | 3.5 | RT - 19D | 508 | 620 | 3421 | 1686 | 136 | 247 | 11.88 | 8.93 | 2.03 |
| 27% in | PCZ | 1 | RF - 4D | 0 | 0 | 0 | 1385 | 356 | 540 | 0.00 | 0.00 | G |
| Xylene | 1:1 | | | | | | | | | | | only |
| | | 2 | RF - 4D | 0 | 0 | 0 | 664 | 167 | 267 | 0.00 | 0.00 | G |
| | | | | | | | | | | | | only |
| | | 3 | RF - 4D | 536 | 155 | 1092 | 997 | 152 | 88 | 7.43 | 4.55 | 1.10 |
| | | 3.5 | RF - 5D | 727 | 262 | 2222 | 1256 | 229 | 93 | 9.97 | 6.90 | 1.77 |
| 15%- | PCZ | 8 | RT - | 1142 | 501 | 2078 | 607 | 0 | 0 | S | | 3.42 |
| THF | 1:1 | | 160D | | | | | | | Only | | |
| 20% in | | 1 | RF - 1D | 585 | 328 | 2135 | 1148 | 64 | 65 | 23.63 | 16.55 | 1.86 |
| THF | | 2 | RF - 1D | 801 | 680 | 2304 | 739 | 10 | 56 | 57.35 | 34.91 | 3.12 |
| | | 3 | RF - 1D | 1571 | 854 | 3811 | 832 | 0 | 0 | S | | 4.58 |
| | | | | | | | | | | Only | | |
| | | 4 | RF - 1D | 1370 | 740 | 3912 | 850 | 0 | 0 | S | | 4.60 |
| | | | | | | | | | | Only | | |
| | | 5 | RF - 1D | 1069 | 589 | 2732 | 584 | 0 | 0 | S | | 4.68 |
| | | | | | | | | | | Only | | |
| 12% MEK | BX1- | 8 | RT - | 39 | 31 | 684 | 3805 | 218 | 962 | 0.64 | 0.58 | 0.18 |
| | 2:1 | | 210D | | | | | | | | | |
| 13% in | BX-5 | 1 | RF - 1D | 0 | 0 | 0 | 3729 | 349 | 1115 | 0.00 | 0.00 | G |
| MEK | 2.3:1 | | | | | | | | | | | only |
| | | 2 | RF - 6D | 0 | 0 | 0 | 2854 | 203 | 803 | 0.00 | 0.00 | 0.00 |
| | | 4 | RF - 6D | 0 | 0 | 0 | 3769 | 230 | 776 | 0.00 | 0.00 | 0.00 |
| | | 6 | RF - 6D | 0 | 0 | 147 | 3346 | 206 | 942 | 0.13 | 0.13 | 0.04 |
| | | 8 | RF - 1D | 0 | 0 | 232 | 3441 | 83 | 755 | 0.28 | 0.28 | 0.07 |
| 4%-EA | BX1- | 8 | RT- | 0 | 0 | 40 | 5915 | 255 | 984 | 0.03 | 0.03 | 0.01 |
| | 2.1 | | 120D | | | | | | | | | |

TABLE 3-continued

CGM Milled by Recycle Mode

| CGM Mill-Base | | Milling | Ageing or | Non-Gamma Peaks (2θ) | | | M-Peak | Gamma-Peaks | | Peak Ratios | | |
|---|---|---|---|---|---|---|---|---|---|---|---|---|
| Solvent | Binder | hr | Treatment | 10.6° | 20.9° | 26.4° | 27.4° | G-7.4° | G-11.8° | Nt/Gt | N26/Gt | N26/P27 |
| 11%-EA | BX-5 1:1 | 8 | RT-68D | 29 | 0 | 11.5 | 3700 | 261 | 565 | 0.05 | 0.01 | 0.00 |
| | | | Add Dx | 0 | 0 | 0 | 1649 | 113 | 476 | 0.00 | 0.00 | 0.00 |
| | | | Add Xy | 0 | 0 | 0 | 1573 | 188 | 503 | 0.00 | 0.00 | 0.00 |
| | | | Add THF | 0 | 0 | 752 | 10796 | 343 | 1439 | 0.42 | 0.42 | 0.07 |

Note:
1) The solvents used for millings were methyl ethyl ketone (MEK), ethyl acetate (EA), 1,4-dioxane (Dx), xylene (Xy), or THF. They were all commercially obtained from Aldrich in Milwaukee, WI.
2) The polymer binders used for milling were polyvinyl butyral (BX-1 or -5, commercially obtained from Sekisui Chemical Co. Ltd., Japan) or polycarbonate-Z200 (commercially obtained from Mitsubishi Engineering-Plastics Corporation, White Plains, NY).
3) The pigment to binder ratio for each CGM mill-base was indicated under the column for binders.
4) Under the column of "Aging or Treatments": a) "-RT" or "-RF" indicates the mill-base was aged at room temperature or in a refrigerator. b) Numbers in front of "D" indicates the number of days that a CGM mill-base was aged before testing.
5) Under the column for "Peak Ratios": a) Nt/Gt is the ratio of total peak areas for non-gamma peaks at (10.6 + 20.9 + 26.4) vs. total of gamma-peaks at (7.4 + 11.8). b) N26/Gt is the ratio of peak areas for non-gamma peak at 26.4 vs. total of gamma-peaks at (7.4 + 11.8). c) N26/P27 is the ratio of peak areas for non-gamma peak at 26.4 vs. the overlapped peak at 27.4.
6) For those values of peak areas lower than 50, the peak intensities may be related to the noise from the background.

Description of Results in Table 3:

a) Pure gamma peaks were observed in the freshly milled CGM samples that were milled by recycle-mode with PC-Z in dioxane for less than 1 hr. or in p-xylene for less than 2 hr. as well as those milled with BX-5 in MEK for less than 4 hr. or with either BX-1 or BX-5 in ethyl acetate for up to 8 hr., indicating that TiOPc remained in pure gamma-form crystals in these samples.

b) Both gamma peaks and non-gamma peaks were observed in freshly milled CGM samples that were milled with PC-Z in THF for less than 2 hr., or in dioxane for more than 1 hr., or in p-xylene for more than 2 hr., indicating that the crystal structure of the gamma-TiOPc has been changed from pure gamma-form to non-gamma form which is believed to be the results of new crystal forms and/or mixture of different crystal forms in a single lattice (ca. gamma, beta, and/or new crystal lattice forms), but as single crystals with varying lattice structure, not as distinct crystal particles of different crystal forms.

c) All the non-gamma peaks listed in the table were observed in freshly milled CGM samples that were milled with PC-Z in THF for more than 3 hr. The completely disappearance of the gamma peaks indicating that the crystal structure of all the gamma-TiOPc has been converted to beta-TiOPc.

d) When gamma-TiOPc was milled with BX-5 in MEK, the freshly milled sample showed only one non-gamma peak at 26.4 after 6 hr of milling. Increasing milling time from 6 hr. to 8 hr. resulted in the increase of the peak at 26.4 (as shown by the ratios of peak areas) while the other non-gamma peaks remained absent. This indicates that a new crystal form may have been formed which is neither a gamma-form nor a beta-form crystal, as the single crystal form (the S-form) had both beta and gamma peaks.

e) Adding THF to a CGM mill-base of which TiOPc remained in gamma-form crystal (i.e., CGM milled with polyvinyl butyral BX-5 in ethyl acetate for 8 hr.) also resulted in the appearance of one non-gamma peak at 26.4, indicating the formation of the new crystal form as discussed above for TiOPc milled with BX-5 in MEK for more than 6 hours.

f) Adding dioxane or p-xylene to a CGM mill-base of which TiOPc remained in gamma-form crystal (i.e., CGM milled with BX-5 in ethyl acetate for 8 hr.), however, did not result in any non-gamma peaks, indicating no changes in crystal structures of the gamma-TiOPc.

g) Aging at room temperature for the CGM after 3.5 hr. milling with PC-Z (polycarbonate Z) in p-xylene resulted in the growth of non-gamma peaks. This is observed in the ratio of peak areas between total non-gamma peaks and gamma-peaks (i.e., Nt'/Gt) that was increased from 1.10 to 2.95 when tested over a twelve day period, the data shown chronologically, from earlier to later.

h) Aging at room temperature for the CGM after 8 hr. milling with BX-5 in MEK resulted in the appearance of additional non-gamma peaks, indicating that the new crystal form associated with one non-gamma peak at 26.4 was not stable in this CGM mill-base at room temperature.

C. TiOPc in CGM Milled by Pass-Mode

Gamma-TiOPc ordered from H. W. Sands for the CGM milling by pass-mode. It was milled with different polymer binders (i.e., PC-Z or BX-5) at different TiOPc/binder ratios and in different solvents (i.e., 1,4-dioxane, p-xylene, THF, and MEK). Listed below in Table-4 are data for different CGM mill-bases along with peak areas from X-ray diffraction at the scanning angles of 7.4, 10.6, 11.8, 20.9, 26.4, and 27.4. Details of these peaks are similar to those discussed in section C, above for TiOPc in CGM milled by recycle-mode.

TABLE 4

CGM Milled by Pass-Mode

| CGM Mill-Base | | Milling | Ageing or | Non-Gamma Peaks (2θ) | | | O-Peak (2θ) | Gamma-Peaks (2θ) | | Peak Ratios | | |
|---|---|---|---|---|---|---|---|---|---|---|---|---|
| Solvent | Binder | passes | Treatment | 10.6° | 20.9° | 26.4° | 27.4° | 7.4° | 11.8° | Nt/Gt | N26/Gt | N26/N27 |
| 15% in Dioxane | PCZ 1:1 | 1 | RF - 5D | 0 | 0 | 0 | 604 | 222 | 250 | Gamma only | | |
| | | | RF - 5D | 0 | 0 | 0 | 520 | 162 | 260 | | | |
| | | 6 | RF - 5D | 0 | 0 | 0 | 1265 | 325 | 507 | | | |
| | | 6P, RT-1 wk | | 182 | 100 | 347 | 1556 | 298 | 515 | 0.77 | 0.43 | 0.22 |
| | | 6P, 50 C-20 hr | | 567 | 531 | 2422 | 491 | 0 | 0 | Non-Gamma only | | 4.93 |
| | | 6P, 110 C-1 hr | | 0 | 0 | 30 | 1002 | 236 | 298 | 0.06 | 0.06 | 0.03 |
| Pigment Dispersed in 10% Dx, 50 C-20 hr | | | | 0 | 0 | 0 | 3286 | 764 | 990 | G only | | |
| 22% in p-Xy | PCZ 1:1 | 3 | RT - 6D | 0 | 0 | 0 | 1152 | 422 | 504 | Gamma only | | |
| | | 4 | RT - 6D | 0 | 0 | 0 | 1169 | 349 | 454 | | | |
| | | 4P, RT-2 wk | | 0 | 0 | 0 | 972 | 430 | 444 | | | |
| 23% in p-Xy | PCZ 1:1 | 1 | RF - 5D | 0 | 0 | 0 | 1719 | 483 | 653 | | | |
| | | 8 | RF - 2D | 0 | 0 | 0 | 1022 | 319 | 402 | | | |
| | | 8 | RF - 2D | 0 | 0 | 0 | 1302 | 285 | 438 | | | |
| | 8P, 50 C-20 hr | | | 0 | 0 | 0 | 1042 | 396 | 325 | | | |
| | 8P, 110 C-1 hr | | | 0 | 0 | 0 | 955 | 226 | 395 | | | |
| | 8P film, 50 C-1 hr | | | 0 | 0 | 0 | 1147 | 368 | 468 | | | |
| Pigment Dispersed in 10% Xy, 50 C-20 hr | | | | 0 | 0 | 0 | 2501 | 349 | 677 | | | |
| 20% in THF | PCZ 1:1 | 1 | RF - 1D | 0 | 0 | 0 | 1022 | 517 | 426 | G only | | |
| | | 8 | RF - 1D | 1004 | 404 | 2110 | 1321 | 137 | 124 | 13.48 | 8.08 | 1.60 |
| 12% in MEK | BX-5 2.3:1 | 1 | RF - 3D | 0 | 0 | 0 | 1897 | 266 | 766 | Gamma only | | |
| | | 4 | RF - 3D | 0 | 0 | 0 | 1733 | 327 | 614 | | | |
| | | 5 | RF - 3D | 0 | 0 | 0 | 2310 | 316 | 821 | | | |
| | | 8 | RF - 3D | 0 | 0 | 0 | 1963 | 256 | 637 | | | |

Note:
1) The solvents used for millings were methyl ethyl ketone (MEK), ethyl acetate (EA), 1,4-dioxane (Dx), xylene (Xy), or THF. They were all commercially obtained from Aldrich in Milwaukee, WI.
2) The polymer binders used for milling were polyvinyl butyral (BX-1 or -5, commercially obtained from Sekisui Chemical Co. Ltd., Japan) or PCZ, which is polycarbonate Z, in these examples specifically polycarbonate-Z200 (commercially obtained from Mitsubishi Engineering-Plastics Corporation, White Plains, NY).
3) The pigment to binder ratio for each CGM mill-base was indicated under the column for binders.
4) Under the column of "Aging or Treatments": a) "-RT" or "-RF" indicates the mill-base was aged at room temperature or in a refrigerator. b) Numbers in front of "D" indicates the number of days that a CGM mill-base was aged before testing.
5) Under the column for "Peak Ratios": a) Nt/Gt is the ratio of total peak areas for non-gamma peaks at (10.6 + 20.9 + 26.4) vs. total of gamma-peaks at (7.4 + 11.8). b) N26/Gt is the ratio of peak areas for non-gamma peak at 26.4 vs. total of gamma-peaks at (7.4 + 11.8). c) N26/P27 is the ratio of peak areas for non-gamma peak at 26.4 vs. the overlapped peak at 27.4.
6) For those values of peak areas lower than 50, the peak intensities may be related to the noise from the background.

Description of Results in Table 4:

a) Pure gamma peaks were observed in the freshly milled CGM samples that were milled by pass-mode with PC-Z in dioxane or in p-xylene as well as the one with BX-5 in MEK, indicating that TiOPc remained in pure gamma-form crystals in these samples.

b) Milling in THF with PC-Z after 1 pass showed only gamma peaks, but after 8 passes, the product resulted in both gamma peaks and non-gamma peaks (note that no samples were tested between 2 and 7 passes). This indicates that after 8 passes of milling, the crystal structure of the gamma-TiOPc has been changed from pure gamma-form to non-gamma form which is believed to be the results of new crystal forms and/or mixture of different crystal forms (ca. gamma, beta, and/or new crystal forms), again with the composite lattice structure within each crystal, not separate crystals with gamma and beta structures.

c) One week of aging at room temperature for the gamma-form CGM sample that was milled with PC-Z in dioxane after 8 passes resulted in the appearance of other non-gamma peaks, indicating that the crystal structure of the gamma-TiOPc has been changed from pure gamma-form to non-gamma form which could be the results of new crystal forms and/or mixture of different crystal forms (ca. gamma, beta, and/or new crystal forms), again with the composite lattice structure within each crystal, not separate crystals with gamma and beta structures.

d) Heating at 50° C. for 20 hr. for the gamma-form CGM sample that was milled with PC-Z in dioxane after 8 passes resulted in the appearance of other non-gamma peaks and disappearance of gamma peaks, indicating that the crystal structure of the gamma-TiOPc has been changed from pure gamma-form to pure beta-form.

e) Heating at 110° C. for 1 hr. for the gamma-form CGM sample that was milled with PC-Z in dioxane after 8 passes resulted in the appearance of a very small non-gamma peak at 26.4, indicating the formation of very small amount of non-gamma-form crystals and lattice structure. However, due to the small size of the peak, it could be some noise from the background.

f) For the gamma-form CGM sample that was milled with PC-Z in p-xylene after 8 passes, heating at 50° C. for 20 hr. or at 110° C. for 1 hr. did not result in any non-gamma peaks. The same CGM system after 4 passes of milling also showed no change after aging at room temperature for 2 weeks. These indicate that the crystal structure of gamma-TiOPc was very stable in the CGM mill-base that was milled with PC-Z in p-xylene by pass-mode.

g) Finally, dispersing gamma-TiOPc in either dioxane or p-xylene followed by heating at 50° C. for 20 hr. did not show any non-gamma peaks, indicating that heating the gamma-TiOPc in a solvent without any polymer binder did not change its crystal structure.

D) Evaluation of Single Layer OPC with TiOPc of Different Crystal Forms

In general, coatings with beta-form TiOPc showed poor electrostatic results (high discharge voltage and poor electrostatic sensitivity) while coatings with either gamma- or S-form TiOPc showed good electrostatic behavior (low discharge voltage and good electrostatic sensitivity). Table-5 lists the peak areas in X-ray diffraction of CGM mill-bases obtained by milling gamma-form TiOPc with different binders in different solvents using different milling methods. The resulting crystal forms of TiOPc in these CGM mill-bases were also identified in Table-5. Table 6 provides the electrostatic results of single layer OPC coatings that were formulated with these three CGM mill-bases.

TABLE-5

Peak Areas in X-Ray Diffraction on CGM Mill-bases

| CGM Mill Base | Crystal | CGM Mill-Base | | Milling | Intensity (a.u.) at X-ray Scanning Angles (2θ) | | | | | | |
|---|---|---|---|---|---|---|---|---|---|---|---|
| Samples | Form | Solvent | Binder | Time | 7.4° | 9.7° | 10.6° | 11.8° | 20.9° | 26.4° | 27.4° |
| MB-Ex-1 | gamma | 12% MEK | BX-5 2.3:1 | 8 Passes | 256 | 3135 | 0 | 637 | 0 | 0 | 1963 |
| MB-Ex-2 | S-form | 13% MEK | BX-5 2.3:1 | 8 hr. | 20 | 1329 | 0 | 459 | 0 | 236 | 2557 |
| MB-Ex-3 | beta | 15% THF | PCZ 1:1 | 8 hr. | 0 | | 1142 | 0 | 501 | 2078 | 607 |

Note:

1) MB-Ex-1 is TiOPc milled with BX-5 at 2.3:1 in 12% MEK after pass mode milling for 8 passes.

2) MB-Ex-2 is TiOPc milled with BX-5 at 2.3:1 in 13% MEK after recycle mode milling for 8 hours.

3) MB-Ex-3 is TiOPc milled with polycarbonate-Z200 in 15% THF after recycle mode milling for 8 hours.

4) BX-5 is a polyvinyl butyral resin that is commercially obtained from Sekisui Chemical Co. Ltd., Japan.

5) Polycarbonate-Z200 is commercially obtained from Mitsubishi Engineering-Plastics Corporation, White Plains, NY.

TABLE-6

Electrostatic Results of Single Layer OPC after 100 cycles

| | Prodstart | | | | | | Changes | | |
|---|---|---|---|---|---|---|---|---|---|
| Examples | Vac | Vdis | Contrast | E½ | Vdk | Vres | ΔVac | ΔVdis | ΔVres |
| Ex-1 | 593 | 38 | 555 | 0.07 | 52 | 18 | −50 | 2 | 3 |
| Ex-2 | 560 | 28 | 532 | 0.08 | 48 | 9 | −11 | −3 | −1 |
| Ex-3 | 643 | 177 | 466 | 0.45 | 46 | 75 | 37 | 74 | 13 |

Note:

1) Ex-1, -2, and -3 were single layer OPC that were formulated with CGM of gamma, S, and beta-form TiOPc, respectively.

2) Coating formulations for the three examples were TiOPc/ETM-17/MPCT-10/binder at 6.5/8.5/32/50.

Figure 32:
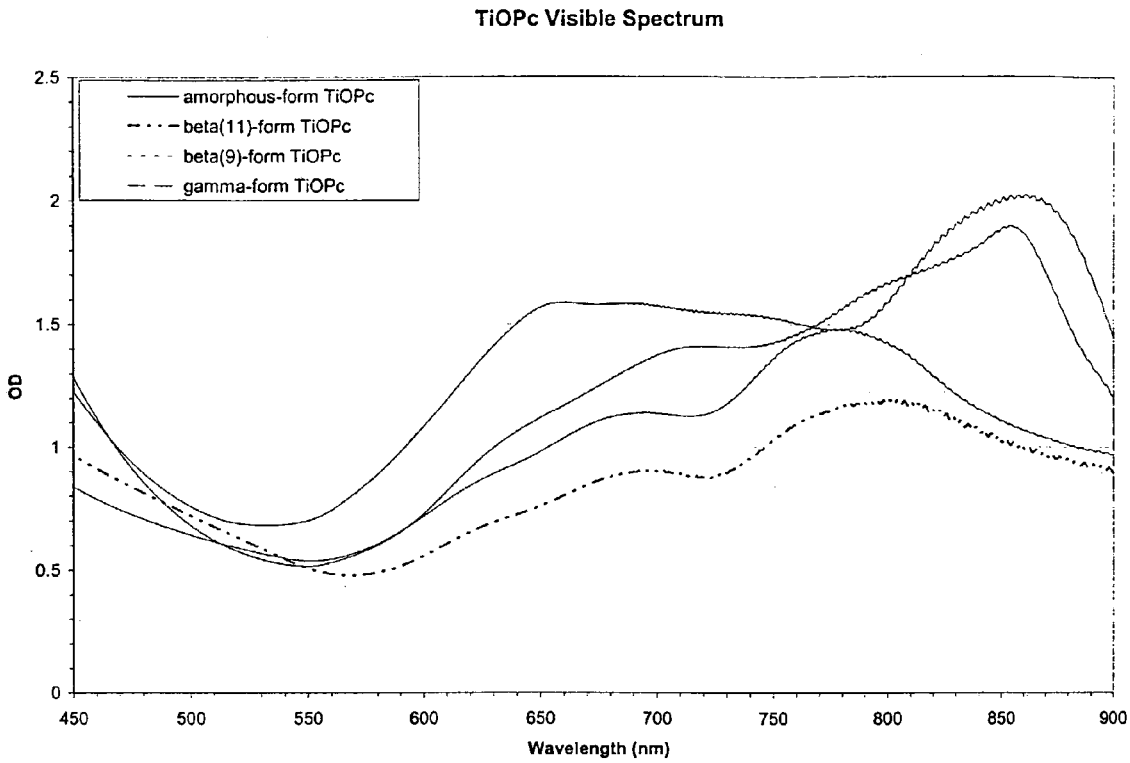
FIG. 32 shows the visible spectra of four different forms of neat, commercial TiOPc: amorphous, beta (9), beta (11), and gamma forms

3) TiOPc was commercially obtained from H.W. Sands Corp., Jupiter, FL;

4) ETM-17 was an electron transport material and was synthesized in the lab;

5) MPCT-10 was a charge transport material and was commercially obtained from Mitsubishi Paper Mills, Tokyo, Japan;

6) Binders used in coatings were polyvinyl butyral resins (BX-1 and BX-5) and were commercially obtained from Sekisui Chemical Co. Ltd., Japan FIG. 32 shows the visible absorption spectra of commercially available amorphous-, beta 9-, beta 11- and gamma-forms of TiOPc. These samples were prepared by dispersing the pigment in polycarbonate binder (no milling) and coating the samples as thin films on clear polyester film.

| Figure Label | Max. Peak Locations (+/−10°) | | | | | | | | | |
|---|---|---|---|---|---|---|---|---|---|---|
| Amorphous | 860 | | | | 740 | | | 690 | 650 | |
| Beta (9) | | | 780 | | | | | 690 | | 630 |
| Beta (11) | | 800 | | | | | 700 | | | 630 |
| Gamma | 850 | 800 | | | 720 | | | | | 630 |

Figure 31:
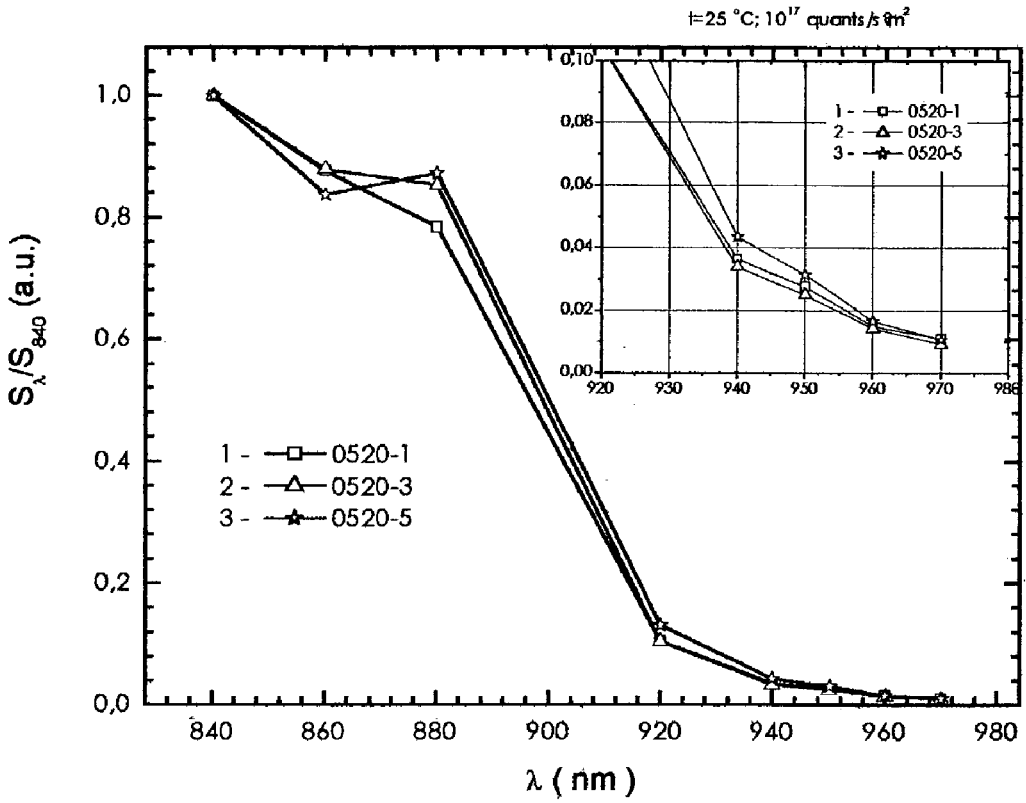
FIG. 31 shows the spectral photosensitivity in the long wavelength region for three different single layer photoreceptor compositions containing either CTM and/or ETM. The insert shows a magnified view of the 920 nm–980 nm region.

FIG. 31 shows the photosensitivity of three different single layer photoreceptor compositions measured in the long wavelength region. Sample 0520-1 formulation contained TiOPc pigment without any hole transporting material or electron transporting material additives, sample 0520-3 formulation contained TiOPc pigment with 20% of ETM-17, and sample 0520-5 formulation contained TiOPc pigment with 20% of ETM-17 and 20% of MPCT-10. A small difference in sensitivity was observed in the region above 900 nm. These differences can be attributed to the charge transfer complexes formed between the transfer materials and TiOPc. It is seen in an insert that addition of electron transporting material and hole transporting materials produced a small increase in sensitivity in the long wave region. These transporting materials do not absorb light in this region and has its photosensitive in the short wavelength region. The sensitivity increase can be attributed to the formation of a charge transfer complex . . . . The spectral sensitivity differences are small and near the measurement accuracy.

1) ETM-17 is (4-n-butoxycarbonyl-9-fluorenylidene)malononitrile made as described in U.S. Pat. No. 4,559,287.
2) MPCT-10 is a commercial charge transport material obtained from Mitsubishi Paper, catalogue ID as MPCT-10.

Examples of Charge Transfer Complexes—Complexes of Charge Generator Materials with a) Charge Transfer Materials or b) Electron Transfer Materials A dual layer organic photoconductor (OGC) material was prepared as follows. A titanyl oxyphthalocyanine dispersion was made by milling a mixture of gamma form of TiOPc (1.0 g, commercially obtained from Syntec, Berlin, Germany), polyvinylbutyral (0.50 g, S-LecB™ BX-1, commercially obtained from Sekisui, Japan), THF (tetrahydrofuran, 20 ml) and a surfactant (one drop of Igepal® CA-720, commercially obtained from Aldrich, Milwaukee, Wis.). This above mixture was placed into a 60 ml glass bottle together with 50 g of YTZ ceramic balls (commercially obtained from Morimura Bros. (USA), Inc., Torrance, Calif.) and shaken in a vibration mill for 1 hour to form a dispersion. The dispersion was diluted with 20 ml of THF and coated on a polyester film having a conductive aluminum layer and a 0.4 μm thick barrier layer comprising methyl cellulose and methylvinylether/maleic anhydride, prepared according to U.S. Pat. No. 6,180,305. After heating for 2 hours at 80° C. 0.6–0.8 μm thick charge generating layer (hereinafter, "CGL") was prepared.

Then a mixture of 1 g of hole-transporting material MPCT-10 (Mitsubishi Co) and 1 g of polycarbonate Z-form (PC-Z) was dissolved in 30 ml of THF. This solution was coated onto CGL and after drying 2 hours at 80° C. forming 10 μm thick charge transporting layer and dual layer OPC was prepared The OPC sample was charged with a Scorotron to which 8.0 kV DC voltage was supplied. The grid potential was +1500 V and the charging time was 1 second. The sample was placed under a vibrating electrometer probe and the potential was measured after charging. The electrometer was connected to a C8-13 memory oscilloscope and the potential decay signal was recorded. The initial potential after charging $U_0$ was measured. After this the sample was illuminated with monochromatic light of different wavelengths in the region from 840 to 930 nm from MDR-23 grating monochromator. Light intensity at the sample surface was $1.35 \cdot 10^{-2}$ W/m$^2$. The potential half decay time $t_{1/2}$ at illumination was measured and photosensitivity S was calculated according to formula $$S=1/t_{1/2} \cdot L$$

where L is incident light intensity. Then photosensitivity spectral dependence was plotted. The photosensitivity was normalized to 1 at 840 nm.

Example 2

The dual layer OPC was prepared and tested according to the procedure for example 1 except that into dispersion before milling 0.2 g of ETM-17 was added.

Example 3

The dual layer OPC was prepared and tested according to the procedure for example 1 except that into dispersion before milling 0.2 g of ETM-17 and 0.2 g of MPCT-10 was added.

What is claimed is:

1. A method of providing an electrophotographic article comprising a complex of charge generating material and at least one transfer material selected from the group consisting of electron transfer material and hole transfer material, the method comprising:

admixing the charge generating material, said at least one transfer material, and an organic binder in a solvent to form a coatable dispersion comprising a complex of charge generating material and said at least one transfer material; and coating said coatable dispersion onto a conductive substrate to form a charge transfer layer on the electrophotoconductive article; wherein the charge generating compound comprises a titanyl oxyphthalocyanine compound which has major peaks in terms of Bragg's 2theta angle to the CuK-α characteristic X-ray wavelength at 1.541 Angstroms at least at 9.5+0.2 degrees, 11.7+0.2 degrees, 15.0+0.2 degrees, 23.5+0.2 degrees, 24.1+0.2 degrees, 26.4+0.2 and 27.3+−0.2 degrees.

2. The method of claim 1 wherein the at least one transfer material comprises an electron transfer material.

3. The method of claim 1 wherein the at lest one transfer material comprises a hole transfer material.

4. The method of claim 1 wherein said charge generating material has a theoretical maximum degree of surface complexing capable with said at least one transfer material, and at least 25% of that theoretical maximum is attained in the charge transfer layer on the electrophotoconductive article.

5. The method of claim 2 wherein said charge generating material has a theoretical maximum degree of surface complexing capable with said at least one transfer material, and at least 25% of that theoretical maximum is attained in the charge transfer layer on the electrophotoconductive article.

6. The method of claim 3 wherein said charge generating material has a theoretical maximum degree of surface complexing capable with said at least one transfer material, and at least 25% of that theoretical maximum is attained in the charge transfer layer on the electrophotoconductive article.

7. A method of providing an electrophotographic article comprising a complex of charge generating material and at least one transfer material selected from the group consisting of electron transfer material and hole transfer material, the method comprising:

admixing the charge generating material, said at least one transfer material, and an organic binder;

contemporaneously dispersing charge generating material, said at least one transfer material, and the organic binder together to form a coatable dispersion comprising a complex of charge generating material and said at least one transfer material; and coating said coatable dispersion onto a conductive substrate to form a charge transfer layer on the electrophotoconductive article; wherein the charge generating compound comprises a titanyl oxyphthalocyanine compound which has major peaks in terms of Bragg's 2theta angle to the CuK-α characteristic X-ray wavelength at 1.541 Angstroms at least at 9.5+0.2 degrees, 11.7+0.2 degrees, 15.0+0.2 degrees, 23.5+0.2 degrees, 24.1+0.2 degrees, 26.4+0.2 and 27.3.+−0.2 degrees.

8. The method of claim 7 wherein the at least one transfer material comprises an electron transfer material.

9. The method of claim 7 wherein the at lest one transfer material comprises a hole transfer material.

10. The method of claim 7 wherein said charge generating material has a theoretical maximum degree of surface complexing capable with said at least one transfer material, and at least 25% of that theoretical maximum is attained in the charge transfer layer on the electrophotoconductive article.

11. The method of claim 8 wherein said charge generating material has a theoretical maximum degree of surface complexing capable with said at least one transfer material, and at least 25% of that theoretical maximum is attained in the charge transfer layer on the electrophotoconductive article.

12. The method of claim 9 wherein said charge generating material has a theoretical maximum degree of surface complexing capable with said at least one transfer material, and at least 25% of that theoretical maximum is attained in the charge transfer layer on the electrophotoconductive article.

13. The method of claim 5 wherein the conductive substrate comprises an aluminum coated polymer.

14. The method of claim 11 wherein the conductive substrate comprises an aluminum coated polymer.

15. The method of claim 12 wherein the conductive substrate comprises an aluminum coated polymer.

16. A electrophotoconductive article comprising a conductive substrate having on at least one surface thereof an organic electrophotoconductive layer comprising a complex of charge generating material and at least one transfer material selected from the group consisting of electron transfer material and hole transfer material, wherein the complex is dispersed in a binder; wherein the charge generating compound comprises a titanyl oxyphthalocyanine compound which has major peaks in terms of Bragg's 2theta angle to the CuK-α characteristic X-ray wavelength at 1.541 Angstroms at least at 9.5+0.2 degrees, 11.7+0.2 degrees, 15.0+0.2 degrees, 23.5+0.2 degrees, 24.1+0.2 degrees, 26.4+0.2 and 27.3+−0.2 degrees.

17. The article of claim 16 wherein the at least one transfer material comprises an electron transfer material.

18. The article of claim 16 wherein the at least one transfer material comprises a hole transfer material.

* * * * *